US007112168B2

(12) United States Patent
Dalebout et al.

(10) Patent No.: US 7,112,168 B2
(45) Date of Patent: Sep. 26, 2006

(54) SELECTIVELY DYNAMIC EXERCISE PLATFORM

(75) Inventors: William T. Dalebout, Logan, UT (US); Jeremy Butler, Paradise, UT (US); Adrian Van Dam, Logan, UT (US)

(73) Assignees: Icon IP, Inc., Logan, UT (US); Reebok International Ltd., Canton, MA (US)

( * ) Notice: Subject to any disclaimer, the term of this patent is extended or adjusted under 35 U.S.C. 154(b) by 47 days.

(21) Appl. No.: 09/737,392

(22) Filed: Dec. 15, 2000

(65) Prior Publication Data

US 2002/0077231 A1 Jun. 20, 2002

(51) Int. Cl.
*A63B 22/16* (2006.01)

(52) U.S. Cl. ..... 482/146; 482/147; 482/79; 482/80

(58) Field of Classification Search ..... 482/146, 482/147, 79, 80
See application file for complete search history.

(56) References Cited

U.S. PATENT DOCUMENTS

| | | | | |
|---|---|---|---|---|
| 785,319 | A | 3/1905 | Miller et al. | |
| 1,755,205 | A | 4/1930 | Christensen | |
| 2,077,233 | A | 4/1937 | Greenhill | |
| 2,455,274 | A | 11/1948 | Scriver | 272/57 |
| 2,521,530 | A | 9/1950 | McGuffage | |
| 2,707,465 | A | 5/1955 | Nemeth | 128/46 |
| 2,714,007 | A | 7/1955 | Jordan | 272/57 |
| 2,829,891 | A | 4/1958 | Ludwig | 272/1 |
| 2,829,892 | A | 4/1958 | Ludwig | 272/1 |
| 2,941,801 | A | 6/1960 | Pedersen | 272/70 |
| 2,991,589 | A | 7/1961 | Ayala | |
| 3,024,021 | A | 3/1962 | Coplin et al. | |
| 3,310,320 | A | 3/1967 | Hanna et al. | 280/87.04 |
| 3,356,367 | A | 12/1967 | Tewksbury | |
| 3,416,792 | A | 12/1968 | Morgan et al. | 272/60 |
| 3,419,267 | A | 12/1968 | Stolle | 272/1 |
| 3,421,163 | A | 1/1969 | Stoughton | |
| 3,427,019 | A * | 2/1969 | Brown | 272/57 |
| 3,451,672 | A | 6/1969 | Kazdan | 272/30 |
| 3,488,049 | A | 1/1970 | Sasser, Jr. | 272/1 |
| 3,511,500 | A | 5/1970 | Dunn | |
| 3,586,321 | A | 6/1971 | Gehrke et al. | 272/33 |
| 3,604,726 | A | 9/1971 | Tracy | 280/205 |
| 3,627,314 | A | 12/1971 | Brown | |
| 3,716,229 | A | 2/1973 | Van Der Cleyen et al. | 272/57 E |
| D227,584 | S | 7/1973 | Perez | |
| 3,758,107 | A | 9/1973 | Potgieter | |
| 3,862,768 | A | 1/1975 | England | 280/205 |
| 3,929,329 | A | 12/1975 | Rivera | 272/57 |
| 3,961,787 | A | 6/1976 | Studebaker et al. | 272/93 |
| 3,967,820 | A | 7/1976 | Harper | 272/70 |
| D241,863 | S | 10/1976 | Friedl | |
| 3,984,100 | A | 10/1976 | Firster | 272/96 |
| 4,065,124 | A | 12/1977 | Egan | |
| 4,067,078 | A | 1/1978 | Winston | |
| 4,159,826 | A | 7/1979 | Hancock | |
| 4,191,371 | A | 3/1980 | Armer, Jr. | 272/111 |
| 4,212,480 | A | 7/1980 | Mikina et al. | |
| 4,263,682 | A | 4/1981 | Bejarano | |
| 4,285,516 | A | 8/1981 | Heatwole | 272/146 |
| 4,386,915 | A | 6/1983 | Gilliam | 434/253 |
| 4,477,072 | A | 10/1984 | DeCloux | |
| 4,491,318 | A | 1/1985 | Francke | 272/146 |
| 4,505,477 | A | 3/1985 | Wilkinson | 272/146 |
| 4,516,767 | A | 5/1985 | Eskijian | |
| 4,516,768 | A | 5/1985 | Gallaro | |
| 4,530,498 | A | 7/1985 | Heatwole | 272/146 |
| 4,592,544 | A | 6/1986 | Smith et al. | |
| 4,601,469 | A | 7/1986 | Sasser, Jr. | 272/146 |
| 4,643,419 | A | 2/1987 | Hyde | |
| 4,700,947 | A | 10/1987 | Heatwole | 272/146 |
| 4,759,542 | A | 7/1988 | Hudec | 272/111 |
| 4,801,140 | A | 1/1989 | Bergeron | |
| 4,817,950 | A | 4/1989 | Goo | 273/148 B |
| 4,826,159 | A | 5/1989 | Hersey | 272/146 |
| 4,850,588 | A | 7/1989 | Desjardins et al. | 272/111 |
| 4,880,226 | A | 11/1989 | Krantz | 272/97 |
| 4,893,809 | A | 1/1990 | Blankenzee | 272/114 |
| D306,049 | S | 2/1990 | Bancroft | D21/191 |
| 4,905,994 | A | 3/1990 | Hartz | 272/146 |
| 4,911,430 | A | 3/1990 | Flament | 272/97 |
| 4,925,183 | A | 5/1990 | Kim | |

(Continued)

FOREIGN PATENT DOCUMENTS

| | | |
|---|---|---|
| DE | 1428843 | 11/1968 |
| DE | 2 032 544 | 1/1972 |
| DE | 2239545 | 2/1974 |
| DE | 3 150 189 A1 | 7/1983 |
| DE | 3 620 706 A1 | 12/1987 |

(Continued)

OTHER PUBLICATIONS

Fitter International Inc., Personal Health & Fitness, Mar. 24, 2000, http://www.fitter1.com/.

(Continued)

*Primary Examiner*—Gregory L. Huson
*Assistant Examiner*—Lori Baker Amerson
(74) *Attorney, Agent, or Firm*—Sterne, Kessler, Goldstein & Fox P.L.L.C.

(57) ABSTRACT

Balancing equipment that provides a selectively dynamic platform for an individual thereon. The weight and movement of the individual causes the platform to tilt in any direction, thereby attempting to throw off the balance of the individual, causing the individual to work on maintaining balance while on the dynamic platform. The dynamic nature of the platform can be adjusted to correspond to the balancing abilities of individuals. An adjustment mechanism increases or reduces the amount the platform is able to tilt, without requiring the raising or lowering of any component of the platform. An exercise mechanism can also be connected to the platform to further modify the dynamic nature of the platform.

40 Claims, 15 Drawing Sheets

U.S. PATENT DOCUMENTS

| | | | | | |
|---|---|---|---|---|---|
| 4,946,160 | A | | 8/1990 | Bertoletti | 272/97 |
| 4,958,832 | A | | 9/1990 | Kim | |
| 4,966,364 | A | | 10/1990 | Eggenberger | 272/111 |
| 4,971,316 | A | | 11/1990 | Dalebout et al. | |
| 5,000,444 | A | | 3/1991 | Dalebout et al. | |
| 5,002,272 | A | | 3/1991 | Hofmeister | 272/146 |
| 5,048,823 | A | | 9/1991 | Bean | |
| 5,062,624 | A | | 11/1991 | Reed | 272/1 R |
| 5,062,629 | A | | 11/1991 | Vaughan | 272/97 |
| 5,078,393 | A | | 1/1992 | Morasiewicz | 272/146 |
| 5,116,045 | A | | 5/1992 | Jahoda | |
| 5,125,880 | A | | 6/1992 | Peters | 482/68 |
| 5,169,363 | A | | 12/1992 | Campanaro et al. | 482/96 |
| 5,190,506 | A | | 3/1993 | Zubik et al. | 482/68 |
| D340,487 | S | | 10/1993 | Traub | D21/712 |
| 5,256,127 | A | | 10/1993 | Yeh | 482/146 |
| 5,292,296 | A | | 3/1994 | Davignon | 482/146 |
| 5,310,395 | A | | 5/1994 | Ko | 482/146 |
| 5,330,399 | A | * | 7/1994 | Fan | 482/34 |
| 5,333,336 | A | | 8/1994 | Langsam | |
| 5,399,140 | A | | 3/1995 | Klippel | 482/146 |
| 5,423,136 | A | | 6/1995 | Gulli | 36/132 |
| D361,604 | S | | 8/1995 | Stroppiana | |
| 5,522,783 | A | | 6/1996 | Gordon | 482/127 |
| 5,536,226 | A | | 7/1996 | Gordon | 482/80 |
| 5,549,536 | A | | 8/1996 | Clark | 482/146 |
| D375,985 | S | | 11/1996 | Dailey et al. | D21/191 |
| 5,577,981 | A | | 11/1996 | Jarvik | |
| 5,584,787 | A | | 12/1996 | Guidry | 482/146 |
| 5,603,334 | A | | 2/1997 | Sharp | 128/779 |
| 5,611,524 | A | | 3/1997 | Gordon | 267/154 |
| 5,643,154 | A | | 7/1997 | Awbrey et al. | |
| 5,643,161 | A | | 7/1997 | Gordon | 482/127 |
| 5,643,165 | A | | 7/1997 | Klekamp | |
| D382,609 | S | | 8/1997 | Szabo et al. | D21/191 |
| 5,667,462 | A | * | 9/1997 | Gordon | 482/80 |
| 5,674,166 | A | | 10/1997 | Gordon | 482/127 |
| 5,683,337 | A | | 11/1997 | Zetocha et al. | 482/146 |
| 5,730,690 | A | | 3/1998 | Guidry | 482/146 |
| 5,749,816 | A | | 5/1998 | Froelich, Sr. et al. | 482/123 |
| 5,755,651 | A | | 5/1998 | Homyonfer et al. | |
| 5,765,921 | A | | 6/1998 | Chuang | 297/423.46 |
| 5,766,119 | A | | 6/1998 | Clark | 482/146 |
| 5,782,639 | A | | 7/1998 | Beal | |
| D396,904 | S | | 8/1998 | Leu | D32/30 |
| 5,810,700 | A | | 9/1998 | Orcutt | 482/123 |
| 5,820,096 | A | | 10/1998 | Lynch et al. | 248/346.01 |
| 5,833,587 | A | | 11/1998 | Strong et al. | |
| 5,851,166 | A | | 12/1998 | Bernardson | |
| D405,135 | S | | 2/1999 | Scott | D21/688 |
| 5,881,407 | A | | 3/1999 | Chu Pt | |
| 5,897,474 | A | * | 4/1999 | Romero | 482/146 |
| 5,899,835 | A | | 5/1999 | Puranda | 482/90 |
| 6,012,188 | A | | 1/2000 | Daniels et al. | |
| 6,042,518 | A | | 3/2000 | Hildebrandt et al. | |
| D428,948 | S | | 8/2000 | Gebhard | D21/686 |
| 6,126,577 | A | | 10/2000 | Chang | |
| 6,322,480 | B1 | | 11/2001 | Lim et al. | |
| 6,413,197 | B1 | | 7/2002 | McKechnie et al. | |
| 6,422,983 | B1 | | 7/2002 | Weck | |
| 6,575,885 | B1 | | 6/2003 | Weck | |
| D478,947 | S | | 8/2003 | Lu | D21/662 |
| D489,423 | S | | 5/2004 | Fan et al. | D21/688 |
| D489,778 | S | | 5/2004 | Fan et al. | D21/688 |
| 6,740,008 | B1 | | 5/2004 | Ho et al. | 482/34 |

FOREIGN PATENT DOCUMENTS

| | | |
|---|---|---|
| DE | 4105313 | 8/1992 |
| EP | 0 134 047 | 8/1983 |
| FR | 2410486 | 12/1977 |
| FR | 2624385 | 12/1987 |
| FR | 2592802 | 1/1988 |
| GB | 2 195 906 | 4/1988 |
| UA | 1372342 | 10/1994 |

OTHER PUBLICATIONS

Balance is Back, Products, Mar. 24, 2000, http://www.balance–boards.com/products.html.

INDO Board Balance Trainer, For Training and Fun, Mar. 24, 2000, http://www.indoboard.com/.

Reebok Ridgerocker, "on information and belief" orders by Dec. 1998; shipping in first quarter 1999.

User's Manual for Weider® Bun & Ab Toner Plus, Model No. WETN07970, Copyright 1997 ICON Health and Fitness, Inc., 4 pgs.

Information Disclosure Statement dated Feb., 2000, from file history of Patent No.6,422,983, 10 pgs.

Information Disclosure Statement dated Aug. 2000, from file history of Patent No. 6,422,983, 5 pgs.

Internet Advertisement for the Tectrix VR Bike, printed Jun. 24, 2000, from the website: htthp:www–pcd.stanford.edu/captology/Examples/Catalog/VRBike/brvike.html, 1 pg.

Duradisk Wobble Board, etc., www.paulchekseminars.com, available on information and belief, at least as early as Feb. 2000.

Exercise Balls; Gymnic Line, etc., www.balldynamics.com, available on information and belief, at least as early as Feb. 2000.

Dyna–Disc Pillow, etc., Perform Better, available on information and belief, at least as early as Feb. 2000.

Disc'O' Sit Air Cushion, etc., www.balldynamics.com, available on information and belief, at least as early as Feb. 2000.

Duradisk, etc., www.paulchekseminars.com, available on information and belief, at least as early as Feb. 2000.

Sit Fit, www.rpsportsinc.com/balance.htm, available on information and belief, at least as early as Feb. 2000.

K.A.T. 2000, www.oemmedical.com, (printed Jan. 10, 2000) (2 pages).

K.A.T 500 product sheet, available on information and belief, at least as early as Feb. 2000.

Lower Extremity, Exercise Equipment (K.A.T. Products), available on information and belief, at least as early as Feb. 2000.

K.A.T. 550 product description, available on information and belief, at least as early as Feb. 2000.

Pogo Ball Drawing, available on information and belief, at least as early as Feb. 2000.

www.myfitnesstrainer.net, 4 selected screen shots (printed Feb. 26, 2001).

Jump Board: Digital Photographs showing a toy called a "jump board" made by Hedstrom Corporation, available on information and belief, at least as early as Aug. 2000.

Preliminary Amendment and Statement Under 37 C.F.R. §1.63(d)(2) Deleting Inventors, filed May 29, 2003 in U.S. Patent Application No. 10/446,778, filed May 29, 2003 (12 pages).

Fitter first; balance and fitness for life, Summer 2003, Available at least as early as Aug. 14, 2003 (8 pages).

Fitter first; balance and fitness for life, www.fitter1.com, printed Jul. 12, 2003 (12 pages).

Bongo; Balance Training Systems, www.balance–boards.com, printed Jul. 12, 2003 (1 page).

Fitter International Inc., Personal Health & Fitness, www.fitter1.com, printed Mar. 24, 2000 (7 pages).

* cited by examiner

SELECTIVELY DYNAMIC EXERCISE PLATFORM

BACKGROUND OF THE INVENTION

1. The Field of the Invention

The present invention relates to exercise equipment and more particularly to balancing equipment that provides a dynamic platform on which an individual exercises. The dynamic platform forces the individual to make an effort to maintain his or her balance.

2. The Prior State of the Art

Balancing devices have been developed for recreation and/or exercise that provide an unstable surface on which an individual balances. One such type of balancing device provides an unstable surface through the use of a cylinder that is free to roll on the ground. A board is placed on top of the cylinder and balance is tested as an individual stands on top of the board and attempts to prevent either of the opposing ends of the board from touching the ground. While this balancing device provides an unstable surface, movement of the board is limited to a side-to-side motion.

A second type of balancing device that provides an unstable surface on which to test an individual's balance employs a sphere that is free to roll or pivot in any direction. Such devices generally include some type of board that is placed on or around the object. Balance is tested as an individual stands on top of the board and attempts to prevent any portion of the board from touching the ground While such balancing devices provide an unstable surface in any direction, frequently the devices are not adaptable to the balancing abilities of individuals.

Another type of balancing device that provides an unstable surface on which to test balance includes a board that pivots about a vertical fulcrum that is connected to a base, which remains stationary on the ground. Balance is tested as an individual stands on top of the board and attempts to prevent any portion of the board from touching any portion of the base. Such balancing devices may allow an individual to increase or decrease the angle along which the board is allowed to pivot prior to touching the base. However, an adjustment mechanism that modifies the pivot angle of the board generally requires the board to be raised or lowered.

SUMMARY OF THE INVENTION

The present invention relates to exercise equipment and more particularly to balancing equipment that provides a selectively dynamic platform on which an individual exercises. The selectively dynamic platform forces the individual to make an effort to maintain balance.

Implementation of the present invention takes place in association with a dynamic platform that provides an unstable surface for an individual. As the individual exercises or moves on the dynamic platform, the weight and/or movement of the individual causes the platform to tilt in a given direction. The individual responds to each tilt in order to attempt to maintain his/her balance. As such, the dynamic nature of the platform causes the individual to work on maintaining balance while performing an exercise.

The dynamic nature of the platform may be selectively adjusted to correspond to the balancing ability of the individual. By way of example, in one implementation a detent adjustment mechanism allows an individual user to select one of a variety of tilt settings The amount that the platform is allowed to tilt is controlled by adjusting a hub to cause a bottom abutment member set to align with a top abutment member set so as to restrict the amount of tilt achieved when one or more of the top abutment members comes in contact with one or more of the bottom abutment members. The amount of tilt is adjusted without requiring any of the components of the platform to be moved vertically. The dynamic nature of the platform may be further modified through the use of an exercise mechanism coupled to the platform. An example of an exercise mechanism includes handles connected to the platform that increase the movement of the platform and the platform's tendency to throw the individual off balance.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE INVENTION

The present invention extends to exercise equipment and more particularly to balancing equipment that provides a selectively dynamic platform on which an individual exercises. The selectively dynamic platform forces the individual to make an effort to maintain balance. The following description of the present invention utilizes a series of diagrams that illustrate the structure of an exemplary embodiment for implementing the present invention. Using the diagrams in this manner to present the invention is for illustration purposes only and should not be construed as limiting the scope of the present invention.

Figure 1:
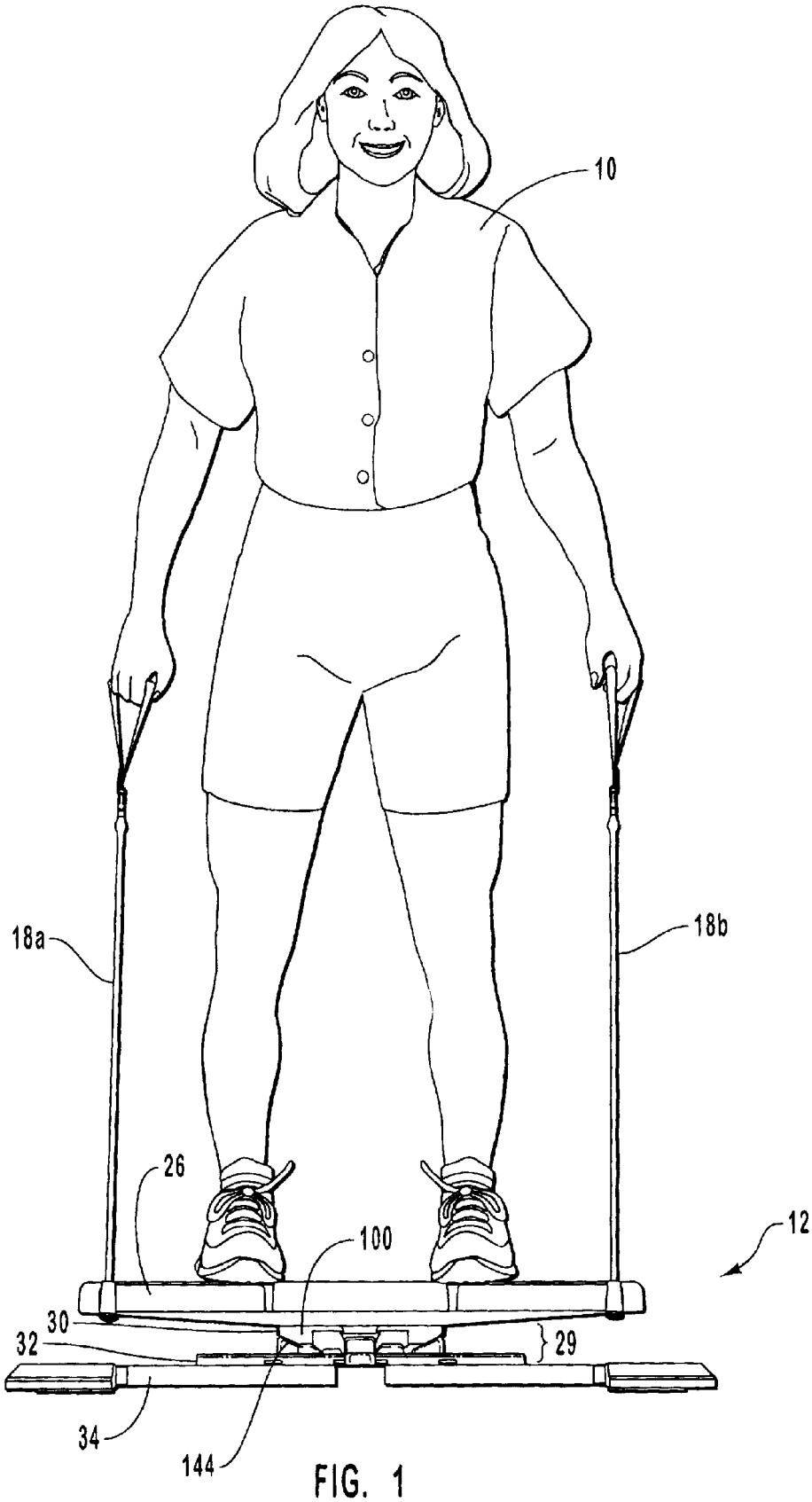
FIG. 1 illustrates an exemplary embodiment of a selectively dynamic platform, in accordance with the present invention and an individual user thereon.

FIG. 1 and the corresponding discussion are intended to provide a general description of an exemplary embodiment of the present invention. In the discussion, reference is made to a selectively dynamic platform upon which an individual may exercise. For purposes of this description and in the claims, the term "dynamic platform" or "dynamic exercising platform" refers to a system of components that provides an unstable surface for an individual. Furthermore, in the description and in the claims, the term "selectively dynamic" refers to an ability to modify the amount of instability.

In FIG. 1, an exemplary embodiment of the present invention is illustrated as dynamic platform 12, which provides a dynamic surface for an individual 10. Dynamic platform 12 includes a board 26 that is selectively dynamic and a base 34 that is stable. The weight and/or movement of the individual 10 causes the board 26 to tilt in any direction. When the board 26 tilts, individual 10 responds in order to maintain his/her balance. As a result, the muscular system of individual 10 is toned while performing an aerobic workout on dynamic platform 12.

Embodiments of the present invention embrace dynamic platforms for which the dynamic nature is selectively adjusted. In one such embodiment, as shown in FIG. 1, a two-part flexible hub 29 is coupled between board 26 and base 34. Two-part hub 29 is adjustable such that the amount of tilt achieved by board 26 is adjustable In the embodiment of FIG. 1, two-part hub 29 comprises (i) a flexible connector 30 flexibly connecting board 26 to base 34, and (ii) a tilt adjuster 32 placed about connector 30 to restrict the amount of tilt achieved by connector 30 to a desired, adjusted amount. Other embodiments in accordance with the present invention include a one-part hub or a several-part hub, wherein the several-part hub includes more than two components.

To achieve the adjustability of hub 29, connector 30 has a set of upper abutment members 100 that selectively align with a set of selected lower abutment members 144, 146 or 148 on tilt adjuster 32, where a set of abutment members comprises one or more individual abutment members. Furthermore, an abutment member may comprise any shape so as to be used to restrict the amount of tilt achieved by the platform, as will be further disclosed below. For example, the upper and/or lower abutment members may have a wedge shape, a wedge shape with a flattened top or bottom portion or a variety of other shapes By selecting a desired set of lower abutment members 144, 146 or 148 upon which the upper set of abutment members 100 is placed, the user can selectively choose the amount of tilt achieved. Abutment members 144, 146 and 148 can be selected by rotating tilt adjuster 32 to a desired position. For example, in FIG. 1, tilt adjuster 32 is adjusted to align upper abutment members 100 with abutment members 144, which is the largest set of abutment members illustrated, such that less tilt is achieved by user 10 than if a smaller set of abutment members were selected, such as abutment members 146 or 148. A detent mechanism may be employed to enable a desired set of lower abutment members, such as abutment members 144, 146 or 148, to be selected and locked in place.

Thus, the dynamic nature of platform 12 may be selectively adjusted by rotating adjuster 32. In other words, the dynamic nature of platform 26 is selectively adjusted by rotating adjuster 32 without requiring the practitioner to move any component of the platform in a vertical direction. This is a highly efficient and advantageous adjustment mechanism that conveniently allows adjustment by rotating adjuster 32 within a horizontal plane rather than requiring the movement of a mechanism in a vertical plane.

One or more handles that are coupled to the dynamic platform may further modify the dynamic nature of the platform. The handles may be permanently coupled or may be removably coupled. In FIG. 1, an example of stretchable elastic handles 18*a* and 18*b* is shown. Handles 18*a* and 18*b* are each selectively coupled to a variety of attachment locations on board 26 and are held by the individual 10 while performing the exercise workout. As individual 10 moves stretchable handles 18*a* and 18*b*, additional force is placed on board 26 to further add to the tilting of board 26. Nevertheless, while the embodiment illustrated in FIG. 1 includes handles 18*a* and 18*b*, embodiments of the present invention also embrace dynamic platforms that are employed without handles.

Therefore, embodiments of the present invention are associated with a dynamic platform that provides an unstable surface for an individual. As the individual exercises or moves on the dynamic platform, the platform is allowed to tilt in a given direction. The user selectively adjusts the amount that the platform is allowed to tilt by aligning a flexible connector with a tilt adjuster, such as through the use of aligned abutment members or through another system that adjusts tilt. The dynamic nature of the platform can be further adjusted through the use of handles held by the individual user.

Figure 2:
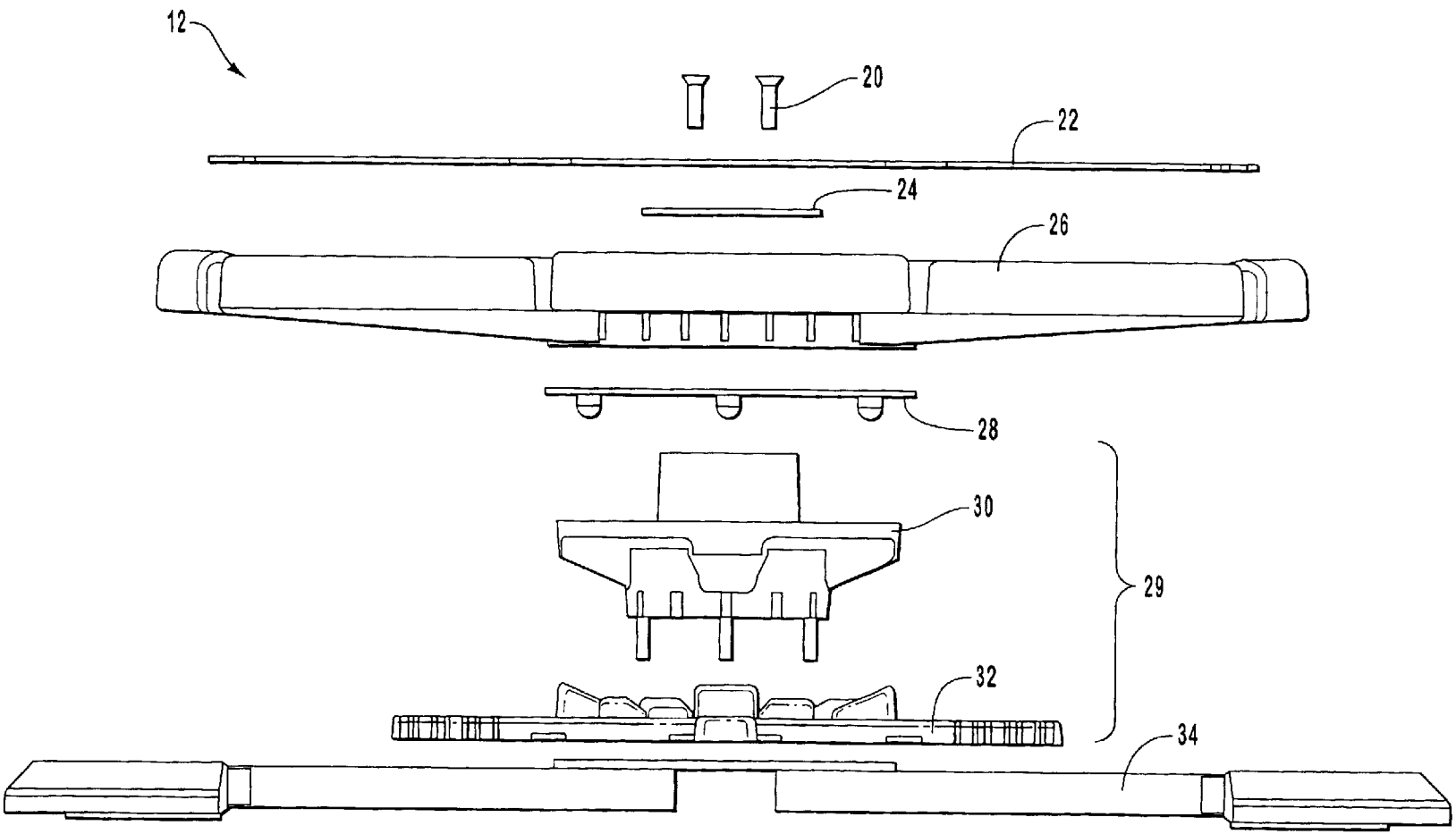
FIG. 2 provides an exploded view of the selectively dynamic platform illustrated in FIG. 1.
Figure 8B:
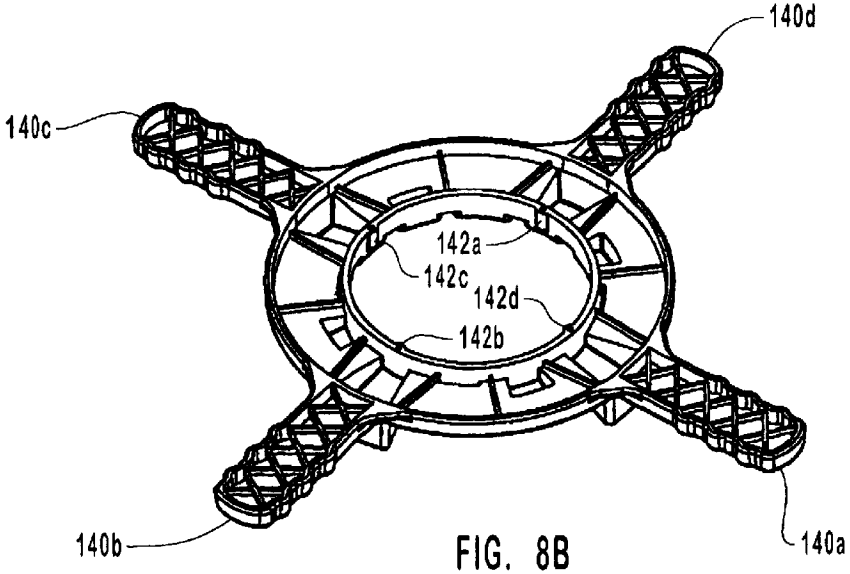
FIG. 8B illustrates a bottom view of the tilt adjuster illustrated in FIG. 8A.
Figure 8A:
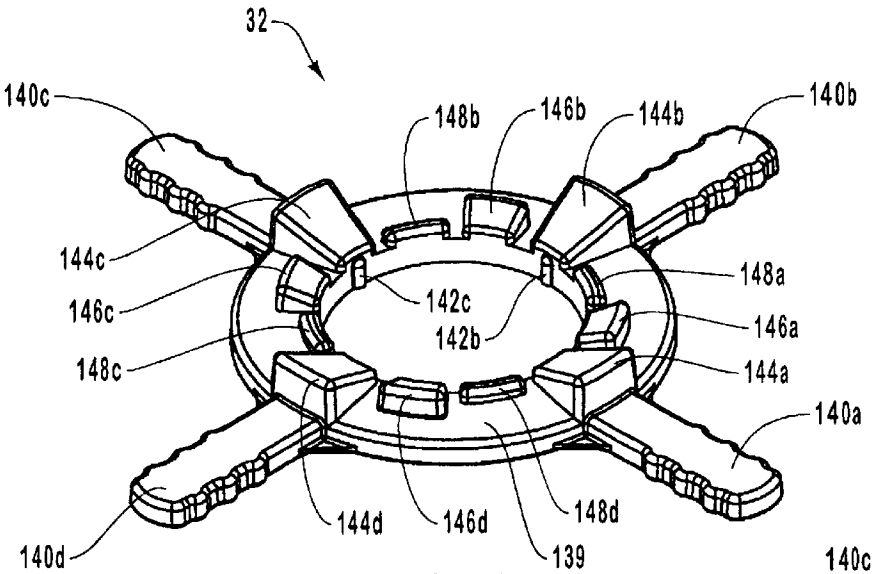
FIG. 8A illustrates a top view of a tilt adjuster of the resistance hub of the platform illustrated in FIGS. 1 and 2.
Figure 9:
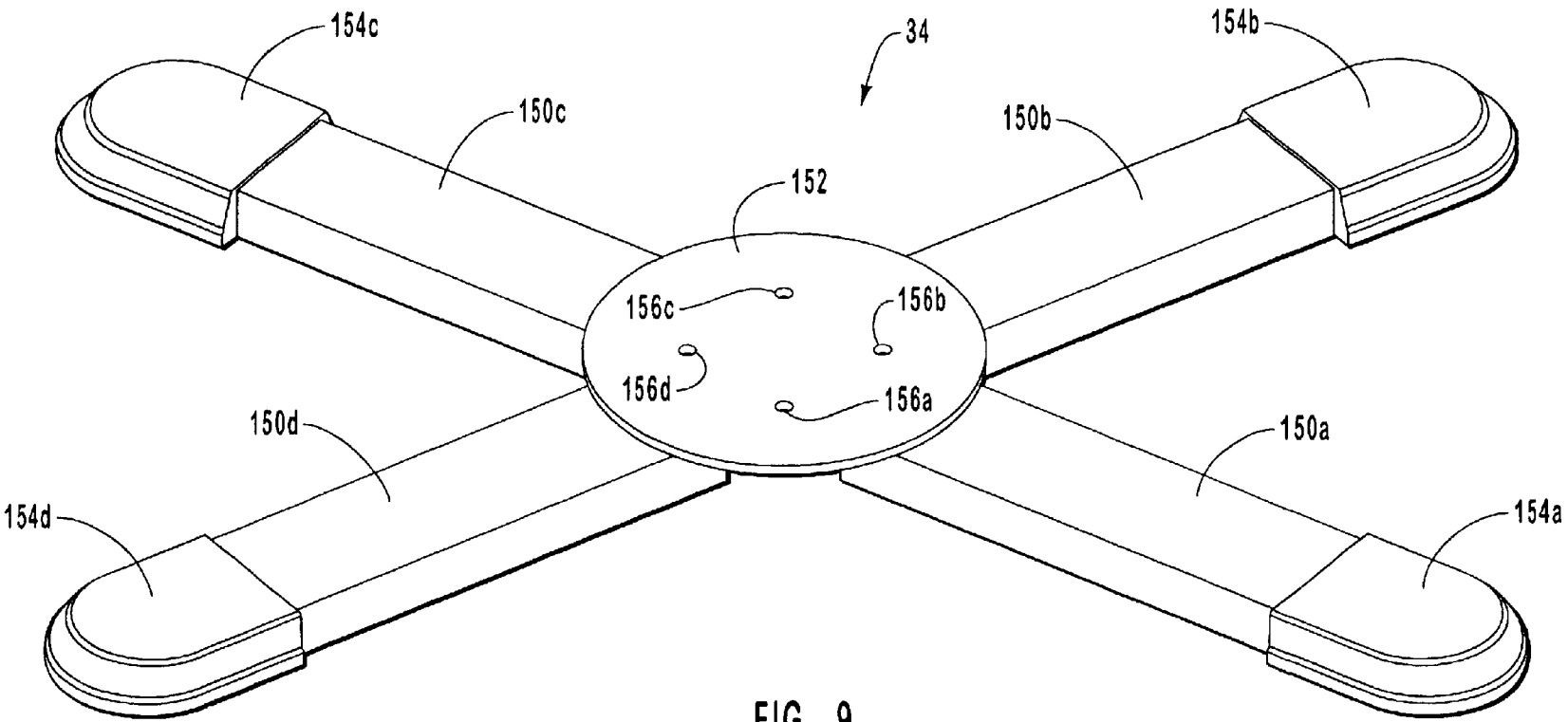
FIG. 9 illustrates a base of the platform illustrated in FIGS. 1 and 2.
Figure 10:
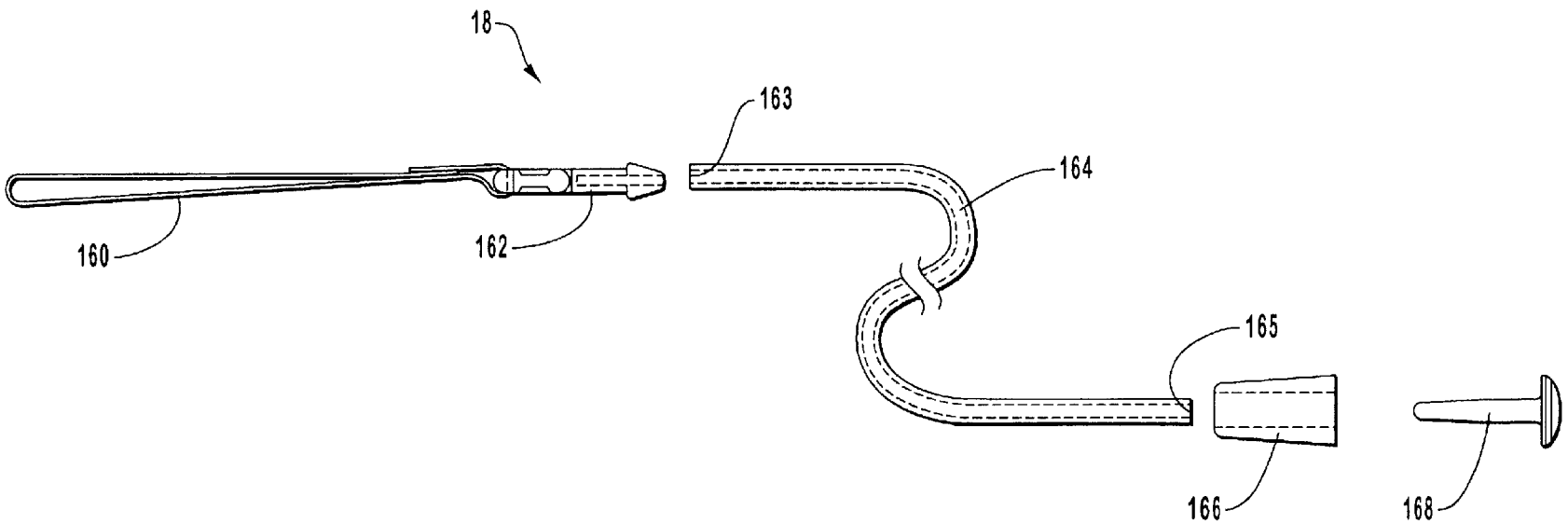
FIG. 10 illustrates a handle that may optionally be used by an individual user in association with a selectively dynamic platform as illustrated in FIG. 1.

The following disclosure, corresponding to FIGS. 2–10, provides additional details as to the various components of an exemplary embodiment of the present invention. FIG. 2 is an exploded view of an embodiment of the present invention and FIGS. 3–9 correspond to individual components of the embodiment of FIG. 2. Furthermore, FIG. 10 provides an exemplary handle that may optionally be used in association with the embodiment illustrated in FIG. 2.

Referring now to FIG. 2, an exploded view of dynamic platform 12 is illustrated. The components of dynamic platform 12 include fastening devices 20 (e.g., screws, bolts, etc.) a mat 22, a plate 24, a board 26, a glide ring 28, a two-part flexible adjustable hub 29, and a base 34. Hub 29 comprises (i) a flexible connector 30 and (ii) a tilt adjuster 32, as discussed above. One or more fastening devices 20 may be used to secure mat 22, plate 24, board 26, and glide ring 28 to connector 30. Optionally, an adhesive is employed or the parts are formed as an integral unit, for example, although other alternatives are available, as will be appreciated by one skilled in the art in light of the disclosure herein. Base 34 and tilt adjuster 32 are secured to connector 30 through the use of anchor bolts 112 that are molded into connector 30.

Those skilled in the art will appreciate that a variety of different types of fastening devices 20 may be used to secure various components of a dynamic platform together, such as screws, bolts, pins, and the like. Furthermore, an adhesive may be used with or without fastening devices 20 to secure a plurality of components together. By way of example, an adhesive may be placed between the underneath surface of mat 22 and the top surface of board 26 to enable mat 22 to be firmly affixed to the top surface of board 26, as will be further explained below.

The following description corresponding to FIGS. 3–9, provides additional details as to components of dynamic platform 12 of FIG. 2. The components include mat 22, plate 24, board 26, glide ring 28, two-part flexible hub 29 and base 34. Furthermore, for convenience of the reader, FIGS. 3–9 and the corresponding description generally follow the order in which the components of dynamic platform 12 are layered from top to bottom, as illustrated in the exploded view of FIG. 2.

Figure 3:
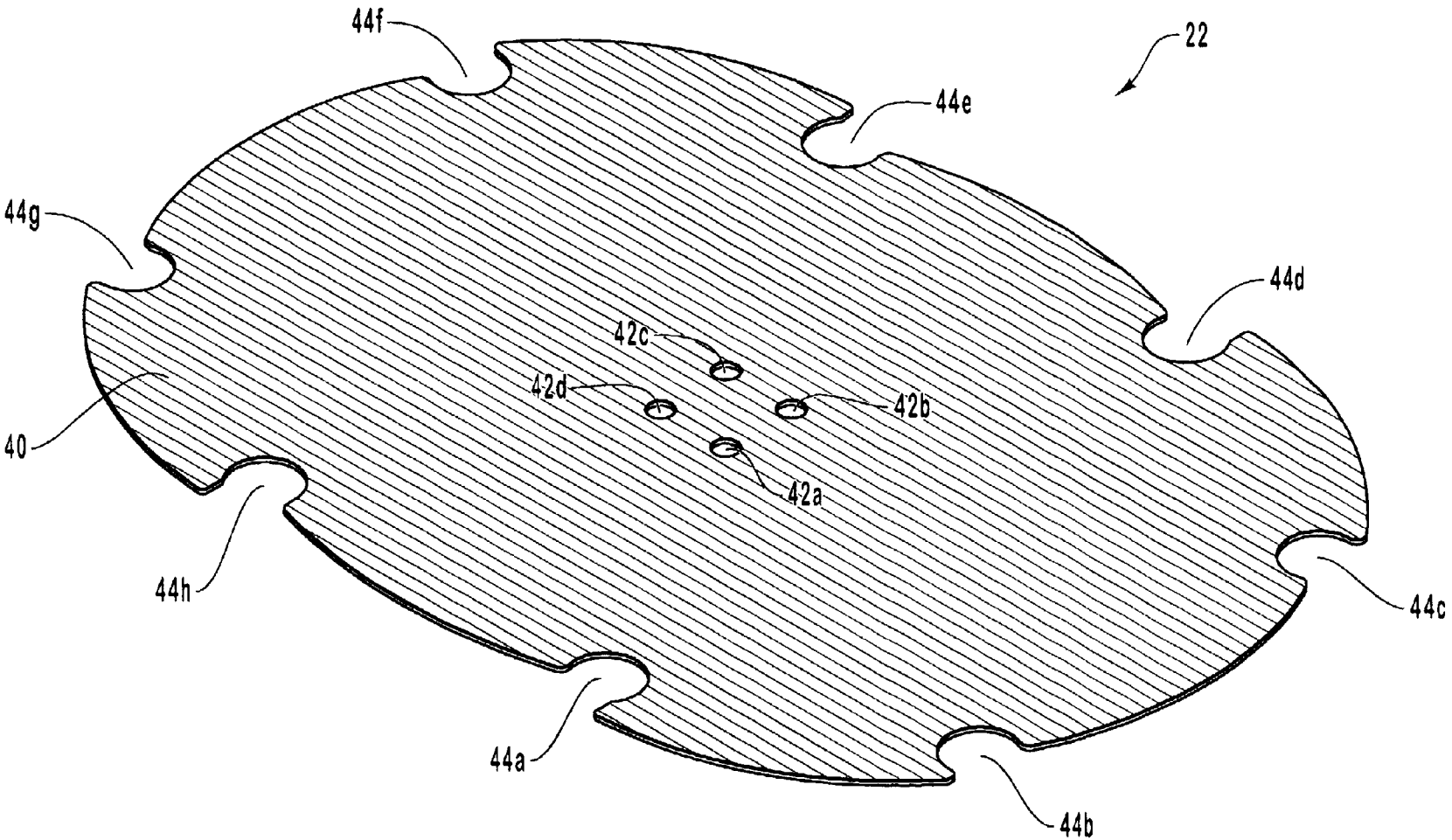
FIG. 3 illustrates a mat of the platform of FIGS. 1 and 2.

Referring first to FIG. 3, an exemplary illustration is provided of a mat, illustrated as mat 22, which may be used as a component of dynamic platform 12 of FIG. 2. An individual that exercises on dynamic platform 12 stands on top of mat 22. Therefore, a texture 40 may be placed on mat 22 to provide a non-slip upper surface for mat 22. Alternatively or additionally, the type of material used for mat 22 may provide a non-slip surface. A material that may be used includes a flexible polyvinyl chloride ("PVC"), such as PVC .50 with a durometer of a shore A, or a low-density polyethylene, for example, or another material that provides a surface of friction between dynamic platform 12 and the individual 10. Mat 22 may also provide a cosmetic appearance to dynamic platform 12. Mat 22 may be manufactured through the process of extrusion or it may be die cut to include a variety of apertures. By way of example, apertures 42*a*–42*d* allow fastening devices 20 (FIG. 2) to be inserted therethrough. In the illustrated embodiment, four fastening devices 20 are used that are placed through mat 22, plate 24, and board 26, as illustrated in FIG. 2. Mat 22 also includes grooves 44*a*–44*h* that correspond to grooves or locations in board 26 and allow an individual to selectively couple a handle to selected locations of dynamic platform 12 of FIG. 2.

Figure 4:
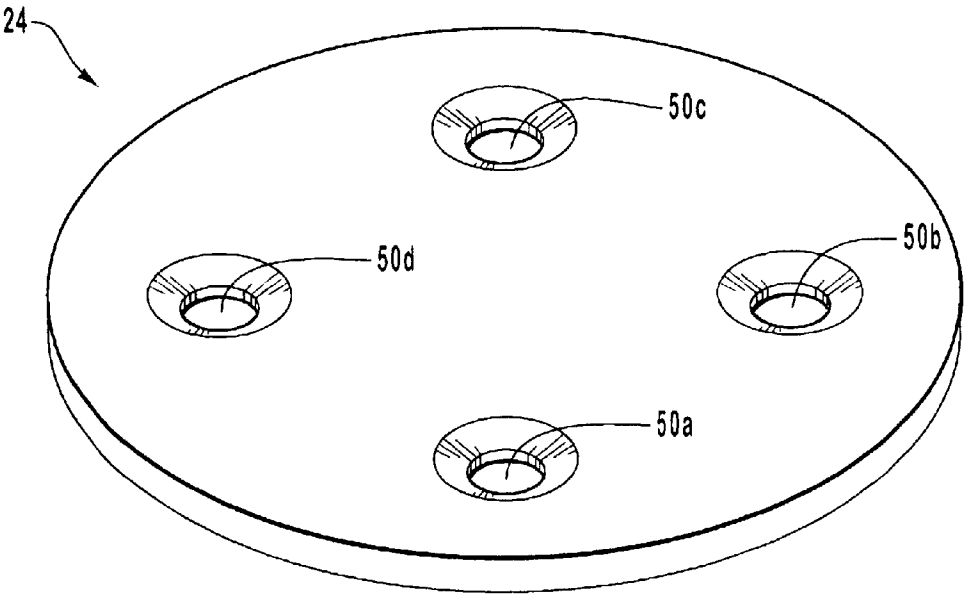
FIG. 4 illustrates a plate of the platform of FIGS. 1 and 2.

Referring now to FIG. 4, an exemplary illustration is provided of a reinforcing plate illustrated as plate 24, which may be used as a component of dynamic platform 12 of FIG. 1. Plate 24 is used as a reinforcement to distribute the force that is applied to the center of dynamic platform 12. Apertures 50*a*–50*c* of plate 24 correspond to apertures 42*a*–42*d* of mat 24 (FIG. 3) through which fastening devices 20 (FIG. 2) may be inserted. Plate 24 can be made from any material that would provide strength to the dynamic platform, such as steel.

Figures 5A, 5B:
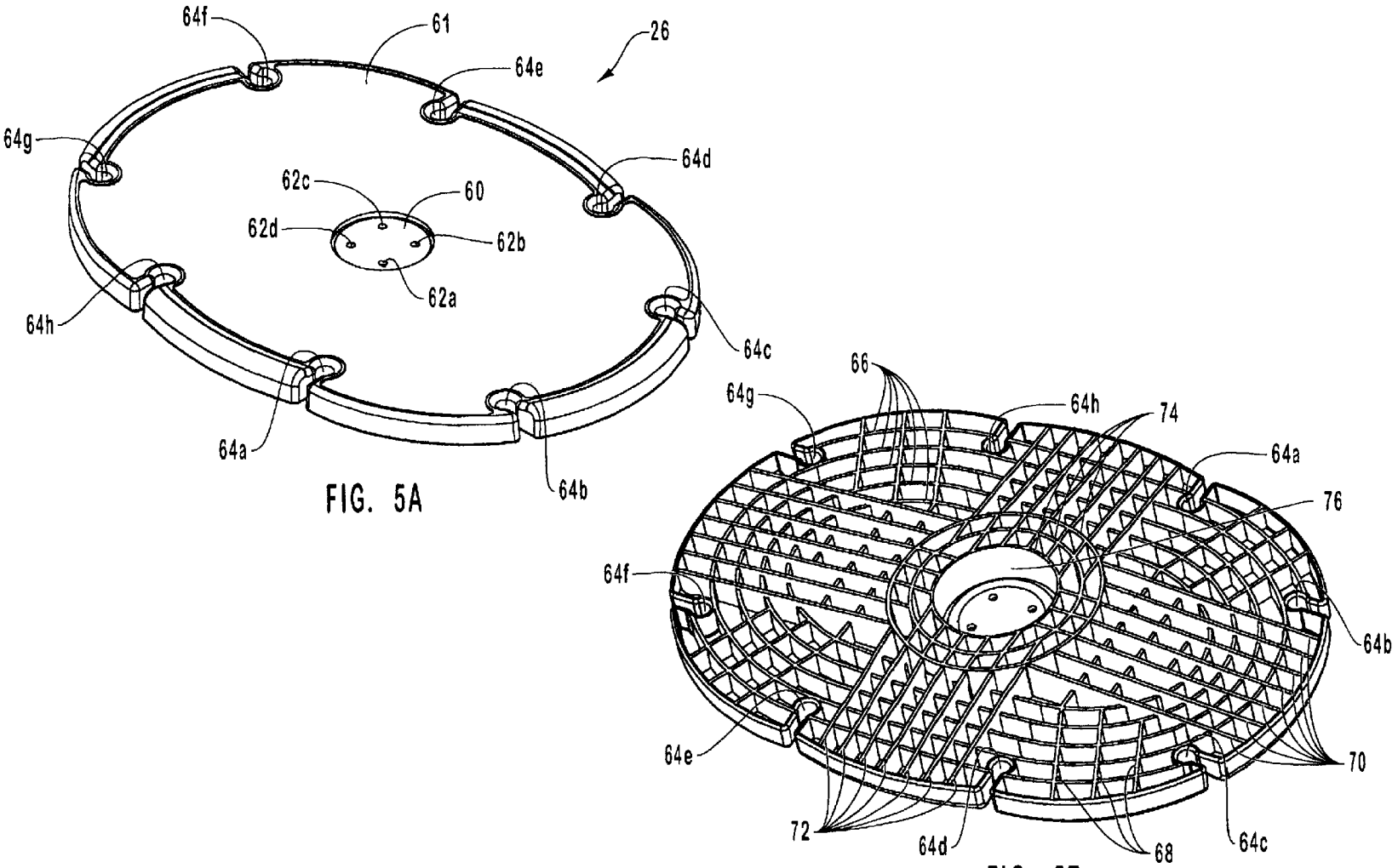
FIG. 5A illustrates a top view of a board of the platform of FIGS. 1 and 2.
FIG. 5B illustrates a bottom view of the board illustrated in FIG. 5A.

Referring now to FIGS. 5A and 5B, an illustration is provided of an exemplary board, illustrated as board 26, which may be used as a component of dynamic platform 12 of FIG. 1. FIG. 5A illustrates a top view and FIG. 5B illustrates a bottom view of board 26. A central, upper portion 60 of board 26 is recessed below the top surface 61 of board 26 so as to allow plate 24 (FIG. 4) to reside therein. When inserted, the top surface of plate 24 is flush with the top surface 61 of board 26. Furthermore, apertures 62*a*–62*d* correspond to apertures 50*a*–50*d* of plate 24 (FIG. 4) and apertures 42*a*–42*d* of mat 22 (FIG. 3) to allow fastening devices 20 (FIG. 2) to be inserted therethrough. Board 26 is made out of a durable material, such as hanna resin ("ABS 433") or the equivalent, which resists fracture when dynamic platform 12 is in use. Grooves 64*a*–64*h* of board 26 correspond to grooves 44*a*–44*h* of mat 22 (FIG. 3) to provide various locations for which handles 18 (FIG. 1) may be selectively attached.

An individual may stand either along the long axis or the short axis of board 26. As illustrated in FIG. 5B, the lower portion of board 26 is reinforced with a rib structure that provides strength to keep board 26 from deforming and/or fracturing. The rib structure includes oval ribs 66, lateral ribs 68, long-axis ribs 70, short-axis ribs 72, and central ribs 74 which are coupled to the upper surface of board 26. Oval ribs 66 provide an even support and to give rigidity to board 26. Lateral ribs 68 provide lateral strength to board 26. Long-axis ribs 70 provide support along the long axis of board 26. Similarly, short-axis ribs 72 provide strength across the short axis of board 26. Central ribs 74 radially distribute the force that is applied at the center of board 26 to prevent a centralized force strain at the center of board 26.

Figure 6:
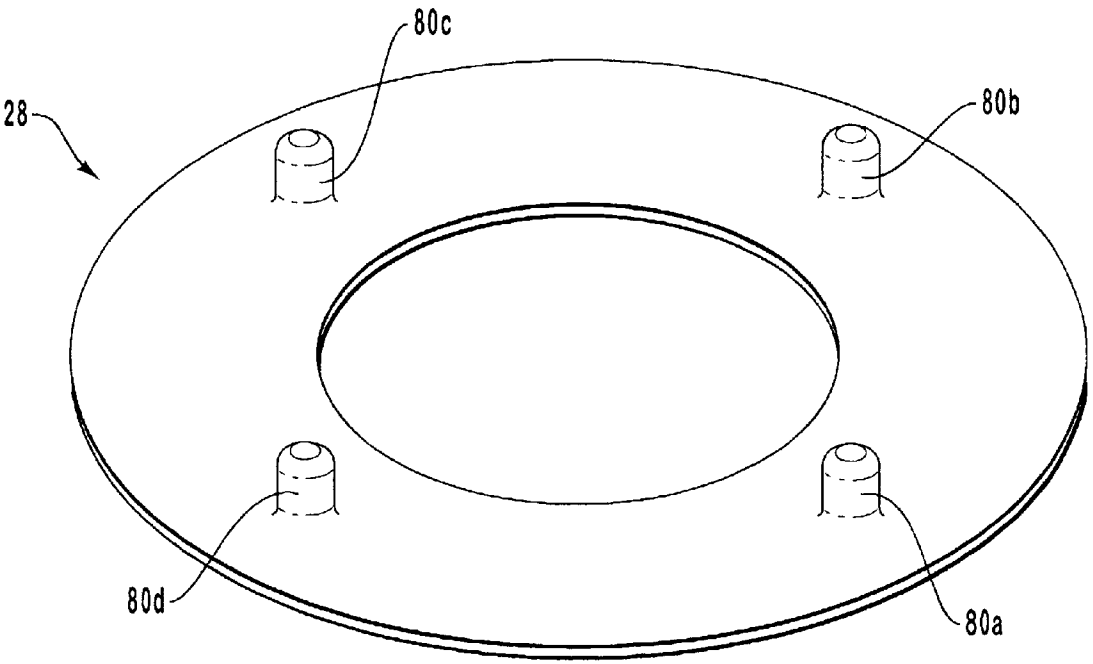
FIG. 6 illustrates a glide ring of the platform of FIGS. 1 and 2.

Referring now to FIG. 6, an exemplary illustration is provided of a friction reducer, illustrated as glide ring 28, which may be used as a component of dynamic platform 12 of FIG. 2. Glide ring 28 is made out of delrin, nylon, high-density polyethylene, high-density polypropylene, or the like to provide a friction-free environment between board 26 and connector 30. FIG. 6 illustrates the bottom view of glide ring 28 so as to illustrate protrusions 80*a*–80*d*, which insert into apertures of connector 30 to maintain glide ring 28 adjacent to connector 30, as will be further explained below.

Figure 7B:
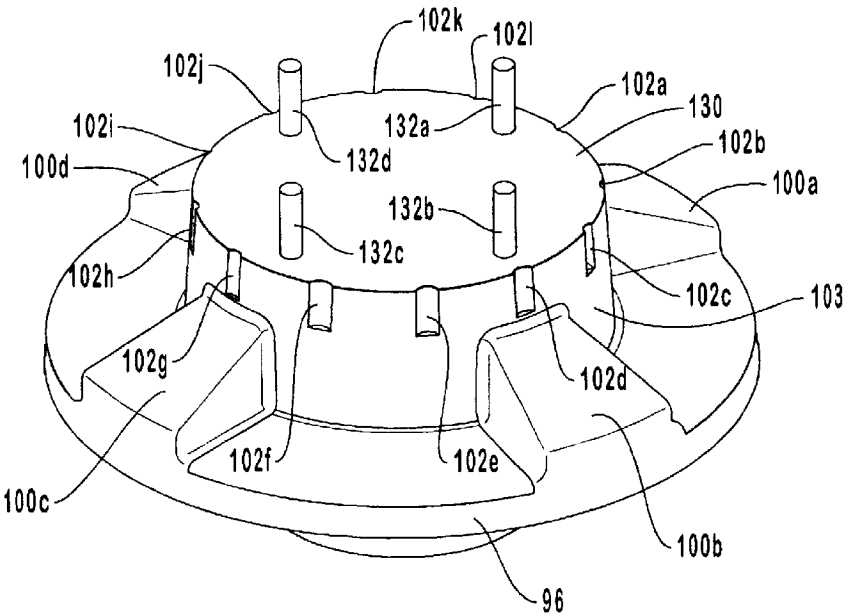
FIG. 7B illustrates a bottom view of the connector illustrated in FIG. 7A.
Figure 7C:
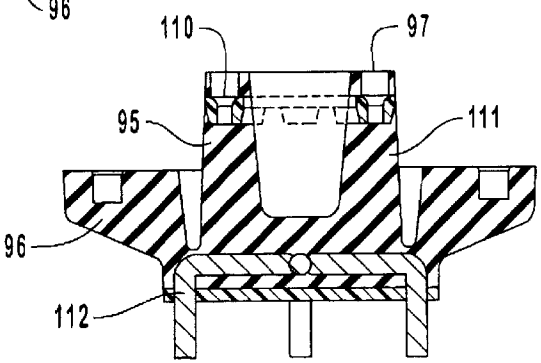
FIG. 7C illustrates a cross-sectional view of the connector illustrated in FIG. 7A.
Figure 7A:
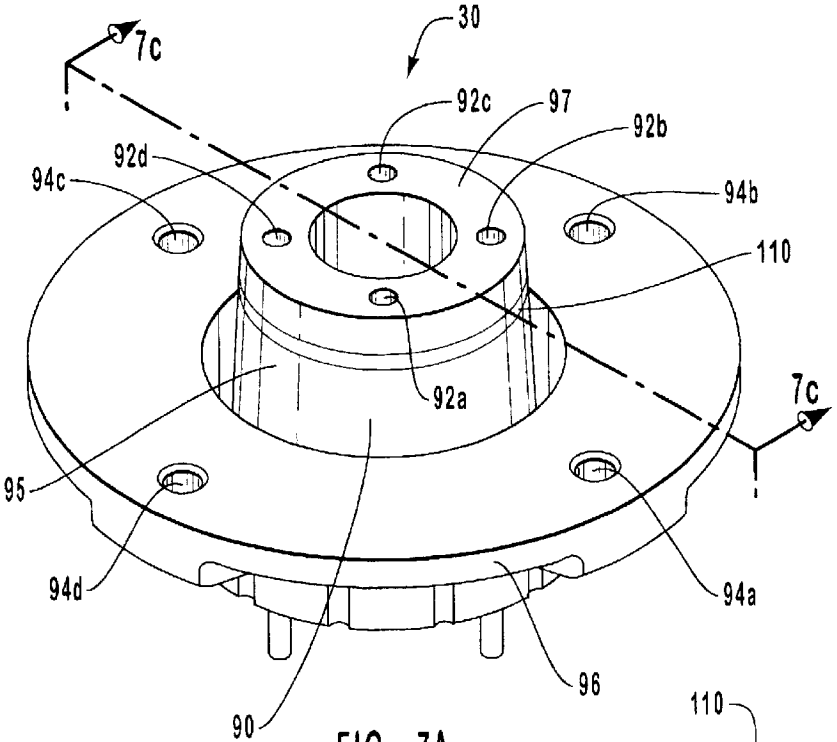
FIG. 7A illustrates a top view of a connector of the resistance hub of the platform illustrated in FIGS. 1 and 2.

Referring now to FIGS. 7A–7C, an exemplary illustration is provided of flexible connector 30. FIG. 7A illustrates a top view, FIG. 7B illustrates a bottom view, and FIG. 7C illustrates a cross-sectional view As illustrated in FIG. 7C, connector 30 comprises: (i) a flexibly dynamic body 111; and (ii) an anchor 112 and nut plate 110 coupled to body 111. In one embodiment, nut plate 110 and anchor 112 are molded inserts. Nut plate 110 is used for receiving fastening devices 20 (FIG. 2), thus securing mat 22, plate 24 and board 26 to connector 30. Anchor 112 is used for fastening connector 30 to base 34. Nut plate 110 and anchor 112 are illustrated independently from body 111 in FIGS. 7D and 7E, respectively.

Dynamic body 111 comprises a flexible material that allows board 26 to tilt in any direction. Examples of such flexible materials include a material latex, a polyurethane, a synthetic rubber, etc. In a further embodiment, the synthetic rubber used for the dynamic body 111 is butal with a durometer 50 shore A.

As illustrated in FIG. 7C, body 111 comprises (i) a central portion 95; and (ii) a wing portion 96 extending outwardly from and surrounding central portion 95. Nut plate 110 is coupled to an upper end of central portion 95, such as by being embedded therein. An upper ring 97 of flexible material is mounted on top of nut plate 110. In one embodiment, ring 97 comprises the same material that is employed for body 111 Anchor 112 is coupled to a lower end of central portion 95 of body 111, as shown in FIGS. 7B and 7C, such that anchor bolts 132*c*–132*d* (FIG. 7B) protrude from body 111.

Glide ring 28, having protrusions 80*a*–80*d* (FIG. 6), resides on the top surface of wing portion 96 (FIG. 7A) and is affixed by lodging protrusions 80*a*–80*d* into corresponding apertures 94*a*–94*d* (FIG. 7A) of wing portion 96. In a further embodiment an adhesive is used to further secure protrusions 80*a*–80*d* in apertures 94*a*–94*d*. Glide ring 28 provides a friction-free surface between connector 30 and board 26.

Connector 30 is coupled to board 26 and base 32. A male portion 90 of connector 30 (FIG. 7A) is inserted into a female portion 76 of board 26 (FIG. 5B). Apertures 92*a*–92*d* of ring 97 (FIGS. 7A and 7C) correspond to apertures 62*a*–62*d* of board 26 (FIG. 5A), which correspond to apertures of plate 24 (FIG. 4), and mat 22 to allow for fasteners 20 (FIG. 2) to be inserted therethrough. Thus, connector 30 is coupled to board 26. Anchor 112 couples connector 30 to base 34, as discussed below.

As illustrated in FIG. 7B, connector 30 also includes a set of abutment members 100*a*–100*d* that mount to the underneath surface of wing portion 96. Abutment members 100*a*–100*d* are an example of the top abutment members referred to above in the discussion corresponding to FIG. 1. In one embodiment, abutment members 100*a*–100*d* are approximately two inches in width and have a tapered angle of 23°, although a variety of different configurations are available. A mating bottom abutment member from tilt adjuster 32 (FIG. 8*a*) aligns with a respective abutment member 100 from connector 30 to limit the amount of tilt the dynamic platform 12 is able to achieve. Receiving sockets 102 are configured to selectively receive protrusions extending from a portion of tilt adjuster 32 in order to align a set of bottom abutment members with abutment members 100, as discussed below.

Figure 7E:
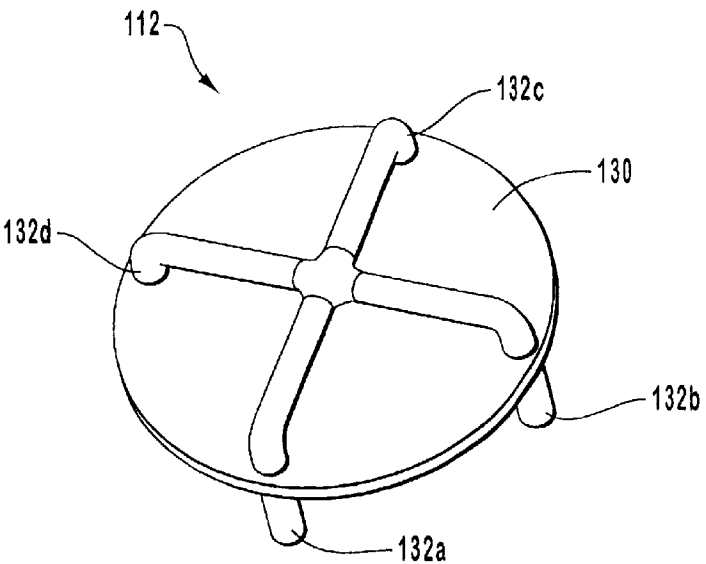
FIG. 7E illustrates an anchor plate of the connector illustrated in FIG. 7A.
Figure 7D:
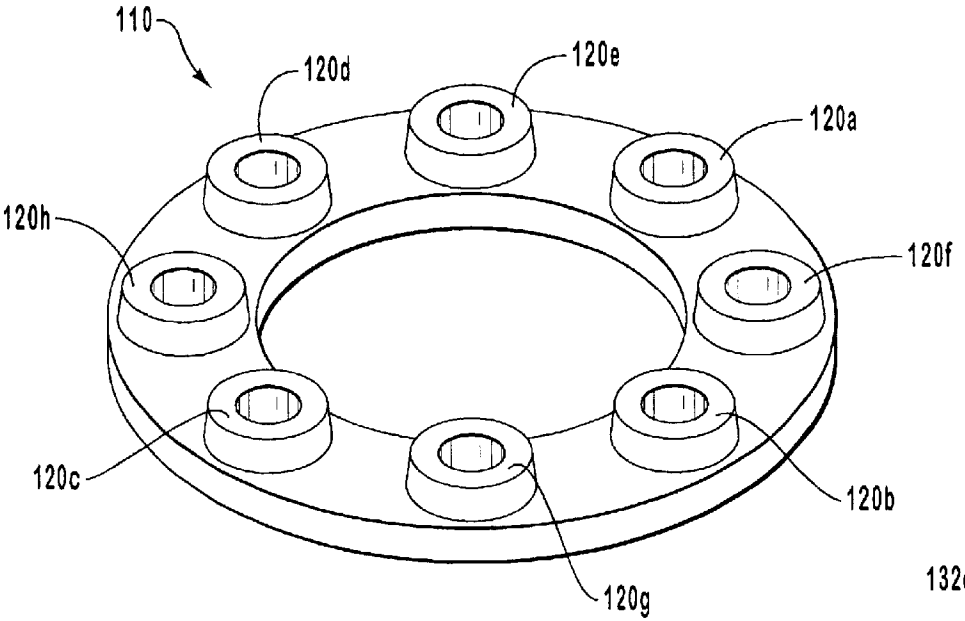
FIG. 7D illustrates a nut plate of the connector illustrated in FIG. 7A.

FIG. 7D illustrates a bottom view of a first insert (optionally molded) that is referred to above as nut plate 110. Plate 110 includes dimpled protrusions 120*a*–120*h* that create surface area to which dynamic body 111 of connector 30 may adhere during a molding process in order to form a reliable bond between nut plate 110 and body 111. In one embodiment, four of the protrusions, e.g., protrusions 120*a*–120*d*, are internally threaded to allow a fastening device 20 (FIG. 2) to be attached thereto in order to couple board 26 to connector 30. The internally threaded protrusions 120*a*–120*d* correspond to apertures 92*a*–92*d* of ring 97 (FIG. 7A), apertures 62*a*–62*d* of board 26 (FIG. 5A), apertures 50*a*–50*d* of plate 24 (FIG. 4) and apertures 42*a*–42*d* of mat 22 (FIG. 3). In one embodiment, as the fastening devices 20 extend down through the board 26 and into the connector 30, a bonding agent, such as an adhesive, is applied to eliminate any twisting between the fastening devices 20 and body 111 of connector 30 to ensure that all movement takes place uniformly.

FIG. 7E illustrates a second insert (optionally molded), referred to above as anchor 112, which includes a steel plate 130 and anchor bolts 132*a*–132*d* coupled thereto. In one embodiment, each anchor bolt 132 is made up of a 5/16th-threaded rod that is bent on a 90° angle with a portion (e.g., 1.37 inches) of the bolt sticking out from the bottom surface of anchor plate 130. Anchor bolts 132*a*–132*d* are tack welded to each other and to anchor plate 130 so as to ensure that each anchor bolt 132 maintains its position. The top surface of anchor plate 130 and any portion of anchor bolts 132*a*–132*d* above the top surface of anchor plate 130 are coupled to dynamic body 111 of connector 30, as illustrated in FIG. 7C, such as through a molding process. The portions of anchor bolts 132 that protrude out of the bottom of connector 30 (FIG. 7B) are affixed to a stationary base 34. Bolts 132 may comprise a variety of different fasteners, such as bolts, threaded screws, pins, etc.

Referring now to FIGS. 8*a* and 8*b*, exemplary illustrations are provided of tilt adjuster 32 which may be used as a component of dynamic platform 12 of FIG. 2. FIG. 8*a* is a top view and FIG. 8*b* is a bottom view of adjuster 32. Connector 30 and adjuster 32 are movably coupled to each other such that adjuster 32 may rotate about lower end 103 of connector 30 (FIG. 7B).

The rotation of tilt adjuster 32 allows for the selective adjustment of the dynamic nature of platform 12. Tilt adjuster 32 includes (i) a circular body 139; and (ii) handles 140*a*–140*d* coupled to body 139 to facilitate a user in rotating tilt adjuster 32 in either a clockwise or counter clockwise direction. As a user rotates tilt adjuster 32, protrusions 142*a*–142*d*, located on the interior diameter of body 139 opposite handles 140 as illustrated in FIGS. 8*a*–8*b*, move from one set of receiving sockets 102 of connector 30 (FIG. 7B) to another set of sockets 102. Each time the protrusions 142 interlockingly mate with a set of sockets 102, a set of bottom abutment members of adjuster 32 is aligned underneath abutment members 100 of connector 30 (FIG. 7B). The combination of sockets 102 and protrusions 142 provides an example of a selectively interlocking detent mechanism.

FIG. 8*a* illustrates three sets of abutment members on tilt adjuster 32, namely abutment members 144*a*–144*d*, abutment members 146*a*–146*d* and abutment members 148*a*–148*d*. Each set of abutment members of tilt adjuster 32 restricts the amount of tilt that board 26 (FIG. 2) can undergo. Therefore, by way of example, when board 26 tilts in a given direction, the tilt causes one or more abutment members 100 of connector 30 to come into contact with one or more corresponding abutment members 144*a*–144*d*, 145A–145*d*or 148*a*–148*d* of adjuster 32 in order to restrict any further tilting of board 26.

The varying size of the three sets of abutment members of tilt adjuster 32 allows for selectable settings of the dynamic nature of platform 12. Abutment members 144 are the tallest of the three sets of abutment members of tilt adjuster 32 and therefore provide the greatest amount of restriction to the tilting of board 26. In contrast, abutment members 148 are the shortest of the three sets of abutment members of tilt adjuster 32 and therefore provide the least amount of restriction to the tilting of board 26. Abutment members 146 are a height between the heights of abutment members 144 and 148 to provide a tilt restriction between the tilt restriction caused by abutment members 144 and the tilt restriction caused by abutment members 148. Therefore, the tilt restriction of dynamic platform 12 is selectable by rotating tilt adjuster 32 so as to select one of the sets of abutment members of adjuster 32 to align or correspond to abutment members 100 of connector 30 (FIG. 7B). While the illustrated embodiment of adjuster 32 includes three sets of abutment members to provide three settings of tilt restriction, other embodiments of the present invention include less than three or more than three settings of tilt restriction.

The moving of protrusions 142 from one set of sockets 102 to another set of sockets 102 aligns a set of abutment members 144, 146 or 148 of adjuster 32 with the abutment members 100 of connector 30 (FIG. 7B). As a user rotates adjuster 32, protrusions 142 (FIG. 8*a*) enter and exit corresponding sockets 102 (FIG. 7B) for each rotational setting.

FIG. 9 illustrates an exemplary embodiment of a stationary support base, illustrated as base 34, which can be used as a component of the exemplary embodiment illustrated in FIG. 2. Base 34 includes a set of legs 150, a central plate 152 and a set of feet 154. One end of each of legs 150 is tack welded to central plate 152 and opposing ends of legs 150 are each fastened to a respective foot 154. Central plate 152 includes apertures 156*a*–156*d* that correspond to and couple with anchor bolts 132*a*–132*d* of connector 30 (FIG. 7C). The coupling of anchor bolts 132 through apertures 156 couples connector 30 to tilt adjuster 32 and base 34. For example, bolts 132*a*–132*d* may have threads thereon which are threadedly coupled to base 34 or may be welded to base 34. Adjuster 32 is movably coupled to connector 30 and selectively rotates about connector 30.

The dynamic nature of platform 12 may also be adjusted through the use of an exercise mechanism coupled to the platform 12. Examples of an exercise mechanism coupled to platform 12 include one or more handles, a cord and pulley system, or any other exercise mechanism that may be coupled to any portion of platform 12 (e.g., top, bottom, and/or within). The exercise mechanism may be coupled to platform 12 such that the exercise mechanism is on top of, underneath or within the platform and can be employed by the individual on the platform.

In FIG. 10, an illustration is provided of an exemplary embodiment of a handle, illustrated as handle 18, which includes grip 160 coupled to a linkage 162 that is in turn coupled to a first end 163 of an elastic member 164. A abutment member 166 is placed about an opposite end 165 of elastic member 164 and a male end of a plunger 168 is inserted into the end 165 of the elastic member 164 so as to hold the end 165 between the plunger 168 and the abutment member 166. When abutment member 166, end 165 and plunger 168 are coupled, abutment member 166 may be selectively inserted into one of the various grooves 64 of board 26 (FIG. 5A) so as to be used while the individual performs an exercise workout on dynamic platform 12.

As illustrated in FIG. 1, an individual 10 on top of dynamic platform 12 may employ an exercise mechanism, such as by pulling one or more handles 18, to increase the dynamic nature of board 26. Therefore, the use of handles 18 further increases the tilting nature of board 26. While FIG. 1 illustrates the use of two handles 18*a*–18*b*, other embodiments of the present invention allow for the use of more than two handles, the use of one handle, or the use of no handles. The stretchable, elastic handles 18 of one embodiment allow the user to increase the dynamic nature of the platform, rather than assisting the user in stabilizing the board.

Figure 11A:
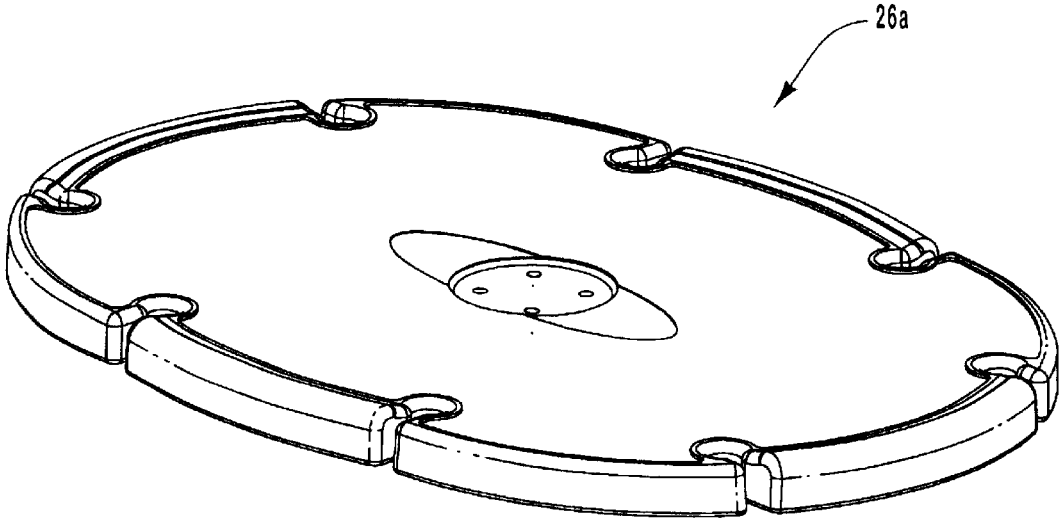
FIG. 11 A illustrates a top view of another embodiment of a board of the platform of FIGS. 1 and 2.
FIG. 11B illustrates a bottom view of another embodiment of a board of the platform illustrated in FIGS. 1 and 2.

With reference now to FIGS. 11A–12F, illustrations are provided of additional embodiments of various components of platform 12 (FIG. 2). FIGS. 11A–11B correspond to additional embodiments of a board that may be used as a component of platform 12. FIGS. 12A–12F correspond to additional embodiments of connectors that may be used as a component of platform 12.

In FIG. 11A, an illustration is provided of a top view of board 26*a*, which is another embodiment of a board used as a component of platform 12. Board 26*a* includes one or more recesses (e.g., oval recesses) on the top surface of board 26*a* into which a mating decorative insert (e.g., a decal) may be coupled.

Figure 11B:
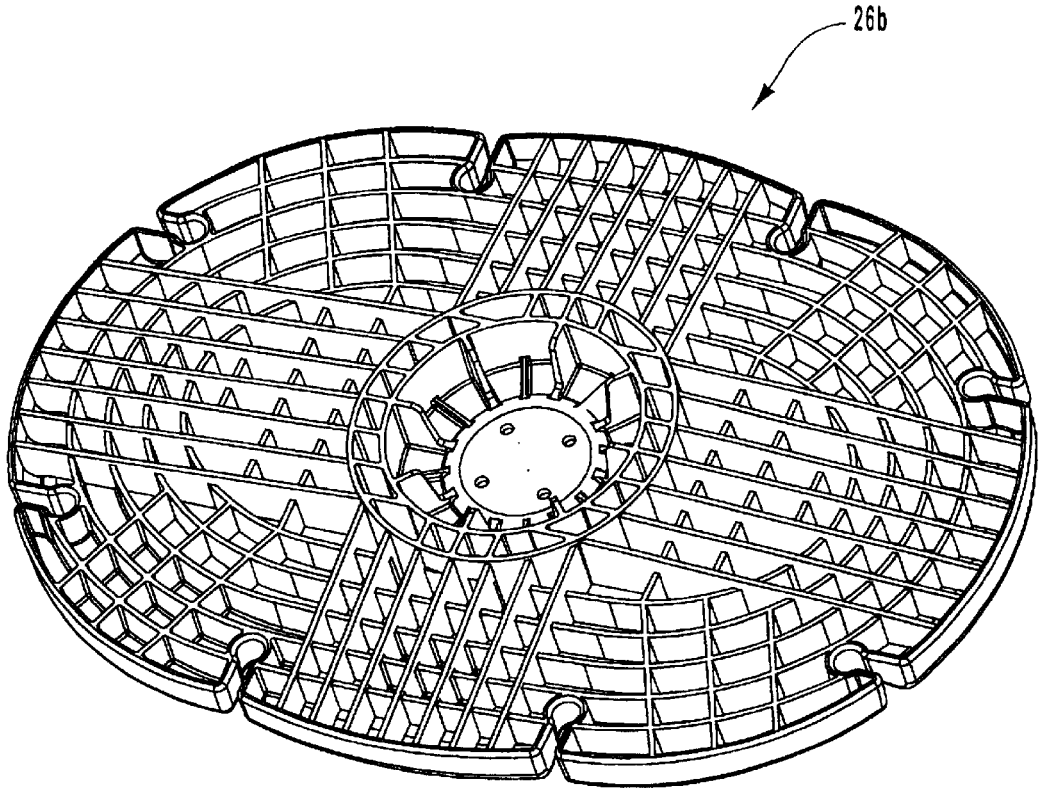

In FIG. 11B, an illustration is provided of a bottom view of board 26*b*, which is yet another embodiment of a board used as a component of platform 12. Board 26*b* includes another configuration of a rib structure, as compared to the rib structure of board 26 illustrated in FIG. 5*b*, which provides strength to keep board 26*b* from deforming and/or fracturing. The illustrated rib structure of board 26*b* includes oval ribs, lateral ribs, long-axis ribs, short-axis ribs, and central ribs that are coupled to the upper surface of board 26*b*. The rib structures of FIGS. 5B and 11B provide structural examples for providing the necessary strength to the board to prevent the board from deforming and/or fracturing while in use.

Figure 12A:
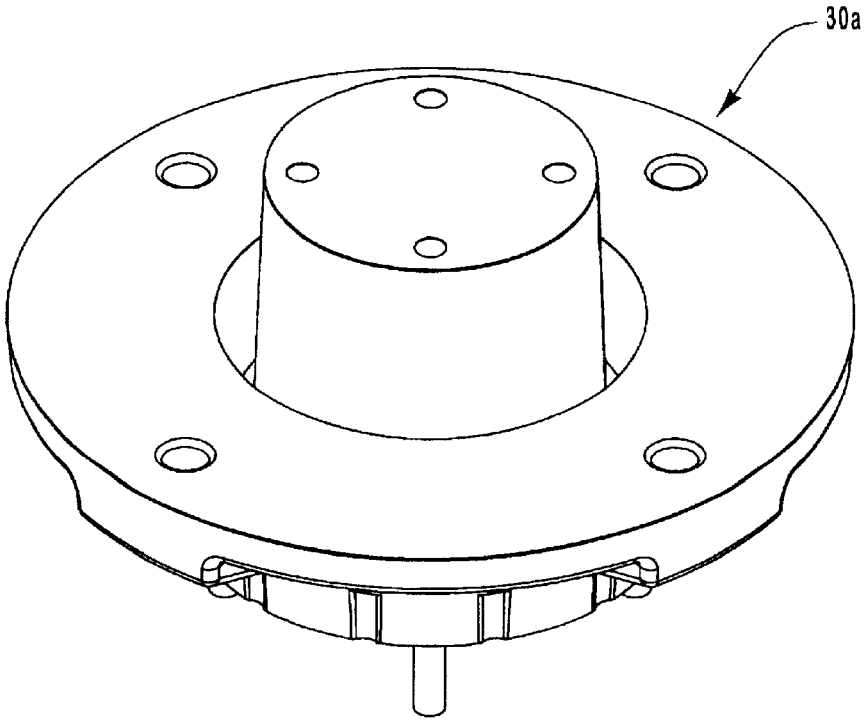
FIG. 12A illustrates a top view of another embodiment of a connector of the resistance hub of the platform illustrated in FIGS. 1 and 2.
Figure 12B:
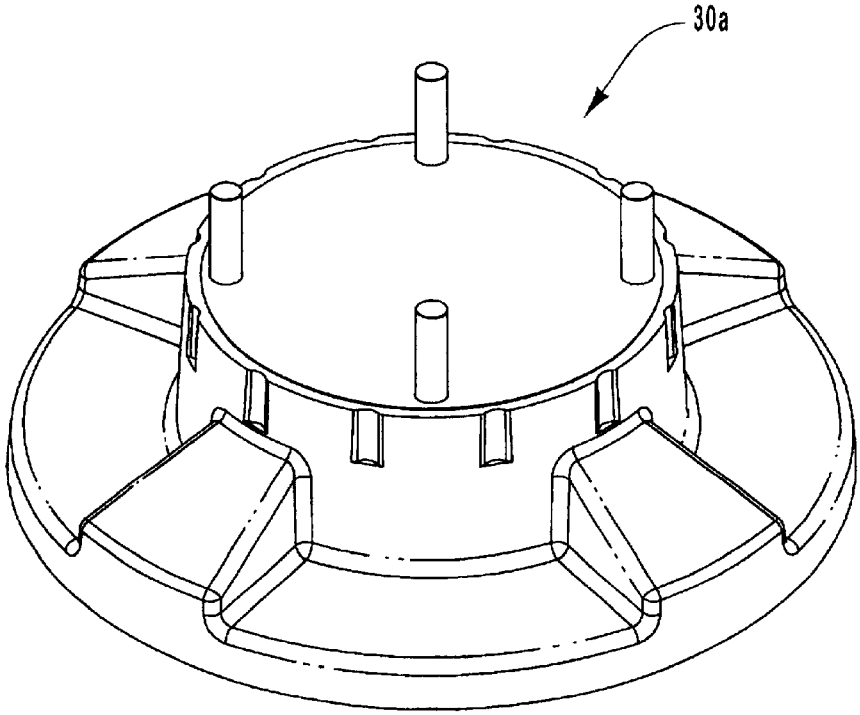
FIG. 12B illustrates a bottom view of the embodiment of the connector illustrated in FIG. 12A.
Figure 12C:
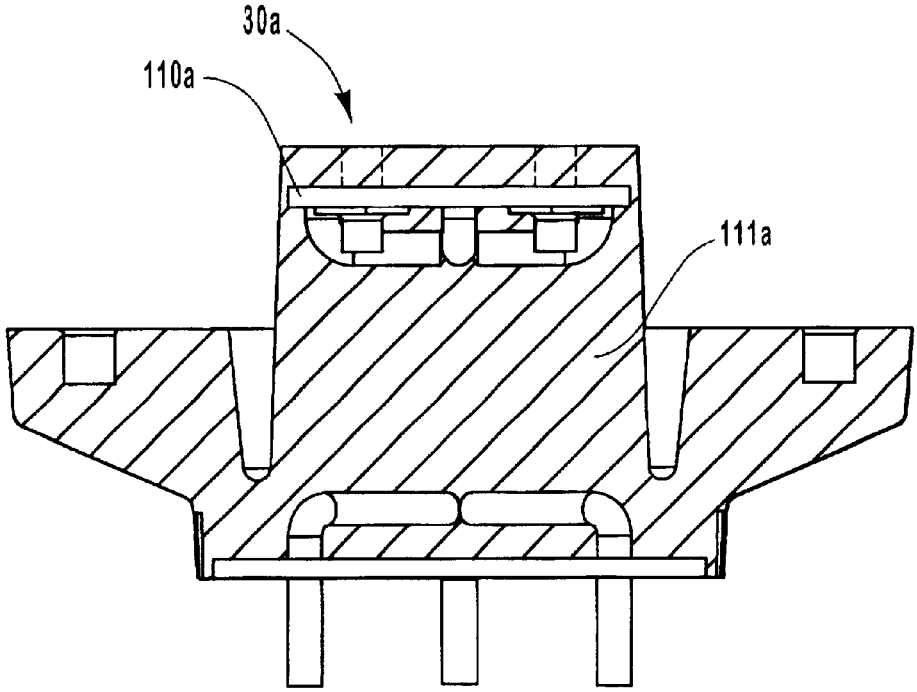
FIG. 12C illustrates a cross-sectional view of the embodiment of the connector illustrated in FIG. 12A.
Figure 12D:
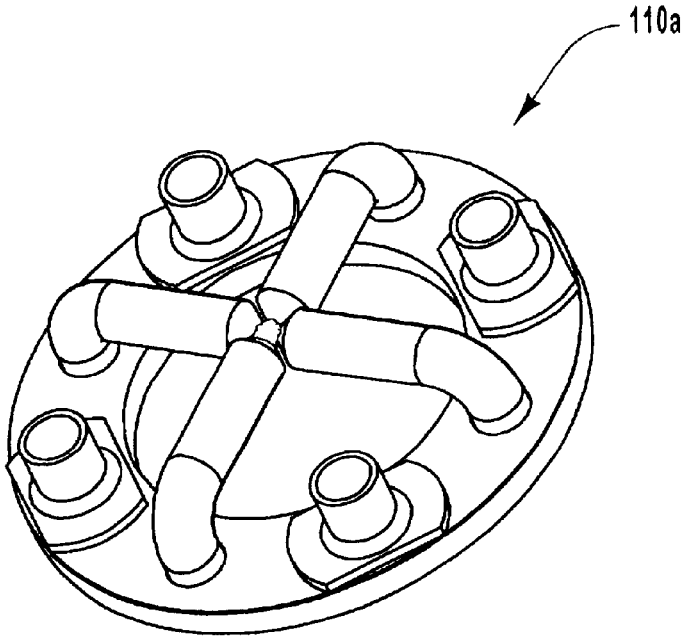
FIG. 12D illustrates another embodiment of a nut plate of the connector.

As provided above, FIGS. 12A–12F provide various additional embodiments of connectors that may be used as a component of platform 12. One embodiment, illustrated in FIGS. 12A–12C includes connector 30*a*, which comprises a solid dynamic body 111*a* (FIG. 12C). The top, bottom and cross-sectional views of connector 30*a* are respectively illustrated in FIGS. 12A, 12B and 12C.

Connector 30*a* includes a nut plate, illustrated as nut plate 110*a*, for coupling connector 30*a* to the board of the platform, and an anchor plate for coupling connector 30*a* to the base of the platform. In one embodiment, nut plate 110*a* comprises four protrusions that are internally threaded to allow a fastening device 20 (FIG. 2) to be attached thereto in order to couple board 26 to connector 30*a*.

Figure 12E:
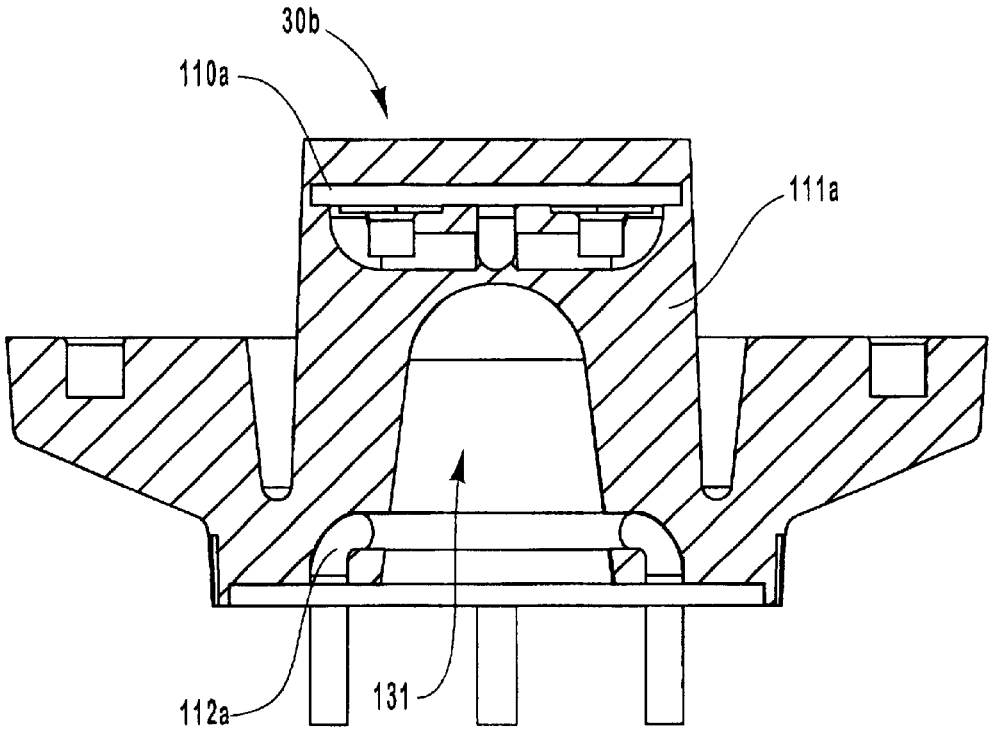
FIG. 12E illustrates a cross-sectional view of another embodiment of the connector.
Figure 12F:
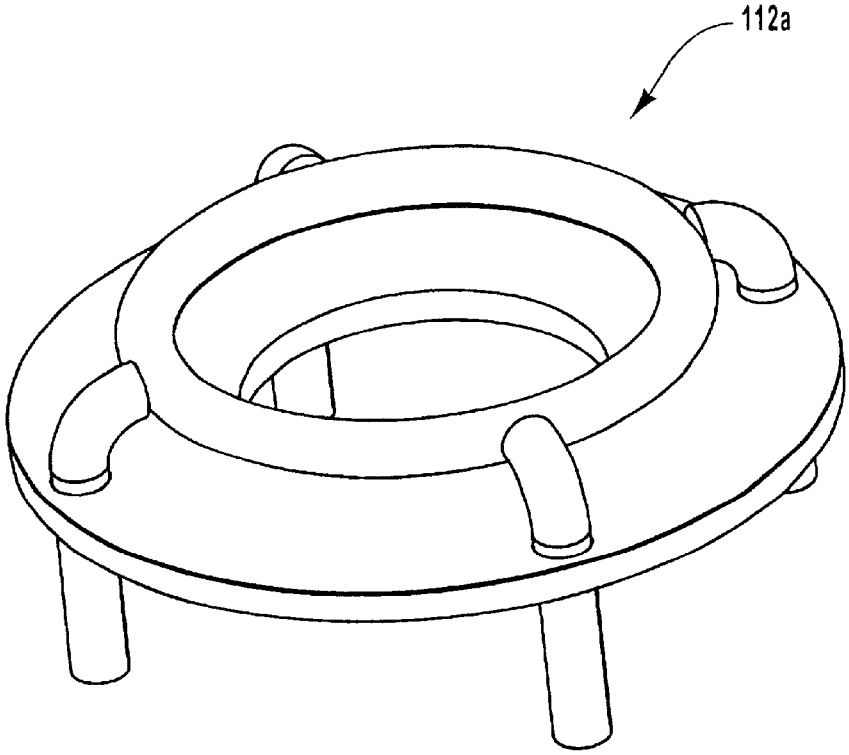
FIG. 12F illustrates another embodiment of an anchor plate of the connector.

Another embodiment, illustrated in FIG. 12E, includes connector 30*b* that comprises a nut plate, an anchor plate and a cavity 131. The anchor plate illustrated is anchor plate 112*a* (FIG. 12F), which provides an opening to cavity 131. The illustrated embodiments of the present invention include a two-part hub that comprises (i) a flexible connector flexibly connecting the board to the base of the platform, and (ii) a tilt adjuster placed about the connector to restrict the amount of tilt achieved by the platform to a desired, adjusted amount. As provided above, other embodiments in accordance with the present invention include a one-part hub or a several-part hub, wherein the several-part hub includes more than two components.

One such other embodiment is a flexible adjustable hub that comprises: (i) a spring that couples the board to the base of the platform; and (ii) a screw that is selectively threaded within the spring along the contours of the spring to thereby decrease the flexibility of the spring. The screw thus acts as an adjuster to restrict the amount of tilt achieved by the platform to a desired, adjusted amount Also included in such other embodiments is a flexible adjustable hub comprising: (i) a ball and socket hub that connects the board to the base of the platform; and (ii) one or more bands coupled between the peripheral edge of the base and the peripheral edge of the board (e.g., two, three or four bands may be employed between the board and the base). The bands may be evenly spaced so as to stabilize the hub. The bands may be flexible, elastic bands having an adjustable length and may act as an adjuster to restrict the amount of tilt achieved by the platform to a desired, adjusted amount.

Thus, the present invention relates to exercise equipment and more particularly to balancing equipment that provides a selectively dynamic platform. As an individual on top of the dynamic platform moves or exercise thereon, the weight and/or movement of the individual causes the platform to tilt in a given direction. As such, the dynamic platform attempts to throw off the balance of the individual, forcing the individual to make an effort to maintain balance.

As explained above, the dynamic nature may be adjusted to correspond to the ability of the individual by rotating the connector to align a set of bottom abutment members with a set of top abutment members to restrict the amount of tilt of the platform. Furthermore, the individual may employ an exercising mechanism coupled to the platform to further increase the dynamic nature of the platform. As such, an individual may test his or her balance or increase his or her exercise workout by doing so on top of the selectively dynamic platform.

As mentioned, the abutment members of the present invention may have a variety of different shapes. For example, in one embodiment, the top portions of lower abutment members 144, 146 and/or 148 are flattened while the lower portions thereof retain the angled wedge shape shown. Flattening the upper tips of these members may allow the adjuster to be moved more freely about the connector. However, the abutment members may have a variety of different shapes that achieve the objects described herein.

The present invention may be embodied in other specific forms without departing from its spirit or essential characteristics. The described embodiments are to be considered in all respects only as illustrative and not restrictive, The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An exercise platform that is dynamic in nature to provide an unstable surface upon which an individual may exercise, the exercise platform comprising:

a stable base;

a board upon which the individual may exercise; and an adjustable hub, wherein a first end of said adjustable hub is coupled to said base and a second end of said adjustable hub is coupled to said board, and wherein said hub is moveable to thereby enable said board to tilt in any direction, wherein said hub comprises a flexible connector and a tilit adjuster movably coupled thereto, wherein said tilt adjuster is disposed about said flexible connector.

2. An exercise platform as recited in claim 3, wherein said hub is configured to move by flexing to enable said board to tilt in any direction.

3. An exercise platform as recited in claim 3, wherein said hub is configured to move laterally to enable said board to tilt in any direction.

4. An exercise platform as recited in claim 1, wherein said tilt adjuster is configured to be selectively rotated about said flexible connector such that upon rotation of said tilt adjuster, the amount to which said board is able to tilt toward said base is adjusted.

5. An exercise platform as recited in claim 4, wherein said tilt adjuster is configured to selectively adjust the amount said board is able to tilt without raising said board.

6. An exercise platform as recited in claim 4, wherein said tilt adjuster is configured to be rotated within a horizontal plane.

7. An exercise platform that is dynamic in nature to provide an unstable surface upon which an individual may exercise platform comprising:

a stable base;

a board upon which the individual may exercise; and an adjustable hub, wherein a first end of said adjustable hub is coupled to said base and a second end of said adjustable hub is coupled to said board, and wherein said hub is moveable to thereby enable said board to tilit in any direction, wherein said hub comprises a flexible connector, wherein said flexible connector includes:

a flexible material; and a plate embedded in the flexible material, said plate having at least one post extending therefrom.

8. An exercise platform as recited in claim 4, wherein said flexible connector includes an upper abutment member and said adjuster includes a lower abutment member, and wherein said lower abutment member is aligned under said upper abutment member to limit the amount to which said board is able to tilt toward said base.

9. An exercise platform as recited in claim 8, wherein said tilt adjuster includes a plurality of lower abutment members, and wherein upon rotating said tilt adjuster about said flexible connector, a lower abutment member is aligned under said upper abutment member to limit the amount to which said board is able to tilt toward said base.

10. An exercise platform as recited in claim 9, wherein the amount to which said board is able to tilt toward said base when one of said lower abutment members is aligned under said upper abutment member is greater than the amount to which said board is able to tilt toward said base when another lower abutment member is aligned under said upper abutment member.

11. An exercise platform as recited in claim 8, wherein said tilt adjuster includes at least one handle to facilitate rotating said adjuster about said flexible connector.

12. An exercise platform as recited in claim 8, wherein said upper abutment member is aligned under at least one of said lower abutment members through the use of a detent mechanism.

13. An exercise platform as recited in claim 12, wherein said detent mechanism includes a protrusion located on said tilt adjuster and a socket located on said flexible connector, such that when said adjuster is rotated about said flexible connector, said protrusion mates with said socket.

14. An exercise platform as recited in claim 13, wherein when a first protrusion resides in said socket, said upper abutment member is aligned under a lower abutment member.

15. An exercise platform as recited in claim 13, wherein when a second protrusion resides in said socket, a second lower abutment member is aligned under said upper abutment member.

16. An exercise platform that is dynamic in nature to provide an unstable surface upon which an individual may exercise, the exercise platform comprising:

a stable base;

a board upon which the individual may exercise; and an adjustable hub, wherein a first end of said adjustable hub is coupled to said base and a second end of said adjustable hub is coupled to said board, and wherein said hub is moveable to thereby enable said board to tilt in any direction, and further including a friction reducer that is interposed between said board and said hub to reduce the amount of friction between said board and said hub.

17. An exercise platform that is dynamic in nature to provide an unstable surface upon which an individual may exercise, the exercise platform comprising:

a stable base;

a board upon which the individual may exercise;

an adjustable hub, wherein a first end of said adjustable hub is coupled to said base and a second end of said adjustable hub is coupled to said board, and wherein said hub is moveable to thereby enable said board to tilt in any direction; and a reinforcing plate, wherein said reinforcing plate is coupled to a center area of said board.

18. An exercise platform as recited in claim 3, further including a non-slip material disposed on an upper surface of said board.

19. An exercise platform as recited in claim 3, further comprising an exercise mechanism coupled to the platform to modify the dynamic nature of the platform.

20. An exercise platform as recited in claim 19, wherein said exercise mechanism comprises at least one handle coupled to the board.

21. An exercise platform as recited in claim 19, wherein said handle is stretchable.

22. An exercise platform as recited in claim 19, wherein a first end of said handle is configured to be held by an individual and a second end of said handle is selectively coupled to said board, such that use of said handle causes said board to tilt.

23. A wobbly apparatus upon which an individual may stand, the wobbly apparatus comprising:

a first support upon which the individual stands;

a second support configured to be placed on a stable surface;

a flexible connector interposed between said first support and said second support, wherein said connector is configured to allow at least one of:

(i) the weight of the individual; and (ii) the movement of the individual to cause said first support to move toward said second support;

a tilt adjuster interposed between said first support and said second support to restrict the movement of said first support towards said second support; and at least one handle made of a stretchable material and coupled to one of said first and second supports.

24. A wobbly apparatus as recited in claim 23, wherein said tilt adjuster comprises a plurality of settings to selectively adjust the amount of said movement of said first support toward said second support.

25. A wobbly apparatus as recited in claim 24, wherein said tilt adjuster is configured to be selectively adjusted between said plurality of settings without vertically displacing any of said first support, said second support, said flexible connector or said tilt adjuster.

26. A wobbly apparatus as recited in claim 23, wherein said handle is removably coupled to said first support.

27. A wobbly apparatus as recited in claim 23, wherein a first end of said handle is held by the individual and a second end of said handle is removably coupled to one of said first and second supports.

28. A wobbly platform upon which an individual may stand, the wobbly platform comprising:

a board;

a base;

a flexible connector interposed between said board and said base, wherein said flexible connector is configured to allow the weight of an individual to cause said board to tilt in any direction; and a tilt adjuster disposed about said flexible connector and moveably coupled for restricting the amount which said board tilts.

29. A wobbly platform as recited in claim 28, wherein said tilt adjuster comprises a plurality of settings to selectively adjust the amount which said board may tilt.

30. A wobbly platform as recited in claim 28, further including at least one handle, wherein a first end of said handle is held by the individual and a second end of said handle is coupled to one of said board or said base.

31. A dynamic platform that provides an unstable surface for an individual, the dynamic platform comprising:

a rigid board for supporting an individual;

a stable base for supporting said board;

a flexible hub for coupling said board to said base and allowing said board to tilt in any direction toward said base, wherein said hub comprises:

a flexible connector having a top abutment member set; and an adjuster that includes one or more bottom abutment member sets, wherein one of said one or more bottom abutment member sets is selectively aligned with said top abutment member set to restrict the amount of tilt of said board.

32. A dynamic platform as recited in claim 31, wherein one of said one or more abutment member sets is configured to be selectively aligned with said top abutment member set without changing a central position of said board.

33. A dynamic platform as recited in claim 31, further comprising one or more handles coupled to said board for modifying the unstable surface of the dynamic platform.

34. An exercise platform that is dynamic in nature to provide an unstable surface upon which an individual may exercise, the exercise platform comprising:

a stable base;

a board upon which the individual may exercise;

a hub, wherein a first end of said hub is coupled to said base and a second end of said hub is coupled to said board, and wherein said hub is flexible to thereby enable said board to tilt in any direction; and a handle having a first end configured to be held by the individual and a second end coupled to the board, wherein said handle is stretchable and coupled to a peripheral portion of the board, such that the use of the handle increases the tilting of the board.

35. An exercise platform as recited in claim 34, wherein said hub is adjustable.

36. An exercise platform as recited in claim 34, wherein the handle is selectively coupled to the board.

37. An exercise platform as recited in claim 34, further comprising a second handle selectively coupled to the board.

38. An exercise platform that is dynamic in nature to provide an unstable surface upon which an individual may exercise, the exercise platform comprising:

a stable base;

a board upon which the individual may exercise located a first distance from said base; and an adjustable hub, wherein a first end of said adjustable hub is coupled to said base and a second end of said adjustable hub is coupled to said board, said hub configured to be adjustable while the platform is in an assembled configuration without altering the first distance between said base and said board such that said hub is conveniently adjustable by a user, and wherein said hub is moveable to thereby enable said board to tilt in any direction.

39. An exercise platform that is dynamic in nature to provide an unstable surface upon which an individual may exercise, the exercise platform comprising:

a stable base;

a board upon which the individual may exercise; and an adjustable hub, wherein a first end of said adjustable hub is coupled to said base and a second end of said adjustable hub is coupled to said board, wherein said hub is moveable to thereby enable said board to tilt in any direction, and wherein said hub comprises a rotatable tilt adjuster that is selectively rotated in order to adjust the amount to which said board is able to tilt toward said base.

40. An exercise platform that is dynamic in nature to provide an unstable surface upon which an individual may exercise, the exercise platform comprising:

a stable base;

a board upon which the individual may exercise; and an adjustable hub, wherein a first end of said adjustable hub is coupled to said base and a second end of said adjustable hub is coupled to said board, and wherein said hub is moveable to thereby enable said board to tilt in any direction, said hub having a handle configured to be grasped by a user and selectively moved such that movement of said handle adjusts said hub.

* * * * *

UNITED STATES PATENT AND TRADEMARK OFFICE
Certificate

Patent No. 7,112,168 B2 Patented: September 26, 2006

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: William T. Dalebout, Logan, UT (US); Jeremy Butler, Paradise, UT (US); Adrian Van Dam, Logan, UT (US); Richard Eldon Fry, Provo, UT (US); Rodney L. Hammer, Lewiston, UT (US); Mark G. Hecox, Canton, MA (US); and Stephanie L. Montgomery, Madison, NJ (US).

Signed and Sealed this Fifteenth Day of May 2007.

(JACKIE) TAN-UYEN T. HO
*Acting Supervisory Patent Examiner*
Art Unit 3764

UNITED STATES PATENT AND TRADEMARK OFFICE

CERTIFICATE OF CORRECTION

PATENT NO. : 7,112,168 B2
APPLICATION NO. : 09/737392
DATED : September 26, 2006
INVENTOR(S) : William Dalebout et al.

It is certified that error appears in the above-identified patent and that said Letters Patent is hereby corrected as shown below:

Claim 1, column 11, line 48, "tilit" should read --tilt--.

Claim 2, column 11, line 51, "claim 3" should read --claim 1--.

Claim 7, column 12, line 3, "may exercise platform" should read --may exercise, the exercise platform--.

Claim18, column13, line 14, "claim 3" should read --claim 1--.

Claim 19, column 13, line 17 "claim 3" should read --claim 1--.

Claim 28, column 14, line 4 "moveably coupled" should read --moveably coupled thereto--.

Claim 34, column 14, line 42, "coupled to said board, and" should read --coupled to said board, said hub comprising a two part member, and--.

Column 14, line 67- Column 15, lines 1-3 "such that said hub is conveniently adjustable by a user, and wherein said hub is moveable to thereby enable said board to tilt in any direction" should be deleted.

Signed and Sealed this

Twelfth Day of June, 2007

JON W. DUDAS
*Director of the United States Patent and Trademark Office*